US008267053B2

(12) United States Patent
Abe

(10) Patent No.: US 8,267,053 B2
(45) Date of Patent: Sep. 18, 2012

(54) INTERNAL COMBUSTION ENGINE

(75) Inventor: Tomoaki Abe, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 740 days.

(21) Appl. No.: 12/513,038

(22) PCT Filed: Dec. 6, 2007

(86) PCT No.: PCT/JP2007/073988

§ 371 (c)(1),
(2), (4) Date: Apr. 30, 2009

(87) PCT Pub. No.: WO2008/072680

PCT Pub. Date: Jun. 19, 2008

(65) Prior Publication Data

US 2010/0031917 A1 Feb. 11, 2010

(30) Foreign Application Priority Data

Dec. 8, 2006 (JP) ..... 2006-332238
Nov. 22, 2007 (JP) ..... 2007-302907

(51) Int. Cl.
*F01P 1/06* (2006.01)

(52) U.S. Cl. ..... 123/41.35; 123/41.34

(58) Field of Classification Search ..... 123/41.34, 123/41.35

See application file for complete search history.

(56) References Cited

U.S. PATENT DOCUMENTS 6,895,905 B2 * 5/2005 Bontaz et al. ..... 123/41.35

FOREIGN PATENT DOCUMENTS

| | | | |
|---|---|---|---|
| FR | 2745329 | A1 * | 8/1997 |
| GB | 2431217 | A * | 4/2007 |
| JP | 50-066052 | U | 6/1975 |
| JP | 62-119423 | U | 7/1987 |
| JP | 01-113125 | U | 7/1989 |
| JP | 07-017937 | U | 3/1995 |
| JP | 07-317519 | A | 12/1995 |
| JP | 09-049456 | A | 2/1997 |
| JP | 3106058 | B2 | 9/2000 |
| JP | 2003-301744 | A | 10/2003 |
| JP | 2006-138307 | A | 6/2006 |

OTHER PUBLICATIONS

"Japan Institute of Invention and Innovation Technical Report," May 1, 1991, p. 1, No. 1991-006590, File No. 9170069-121-84. English Partial Translation.

* cited by examiner

*Primary Examiner* — Noah Kamen
(74) *Attorney, Agent, or Firm* — Sughrue Mion, PLLC

(57) ABSTRACT

There is provided an internal combustion engine in which the inside thereof is uniformly cooled. In an engine serving as the internal combustion engine, a piston reciprocates within a bore provided in a cylinder block, and a connecting rod coupled to the piston transmits motive power to a crankshaft. The internal combustion engine includes a rear-side oil jet through which oil is injected from the connecting rod side of the piston to a skirt inner region and a skirt outer region of the piston.

2 Claims, 25 Drawing Sheets

INTERNAL COMBUSTION ENGINE

TECHNICAL FIELD

The present invention relates to an internal combustion engine, and more particularly, to an internal combustion engine lubricated with oil.

BACKGROUND ART

Conventionally, internal combustion engines are disclosed in, for example, Japanese Patent Laying-Open No. 2003-301744 (Patent Document 1), Japanese Patent Laying-Open No. 9-49456 (Patent Document 2) and Journal of Technical Disclosure No. 91-6590 (Non-patent Document 1).

DISCLOSURE OF THE INVENTION

As to conventional internal combustion engines, Patent Document 1, for example, discloses a configuration in which oil is injected from two oil jets to the inside of a piston skirt. Specifically, Patent Document 1 discloses the art of providing nozzles from which oil is injected toward the crankshaft side of a piston.

With the conventional art, however, it is difficult to cool a bore although the temperature of the central portion of the piston can be reduced because the oil is injected to the inside of the piston skirt. If the oil is directly injected to the bore in order to cool the bore, the consumption of oil is undesirably increased.

Therefore, the present invention is directed to solving the problems as described above, and an object thereof is to provide an internal combustion engine in which the inside thereof can be uniformly cooled.

An internal combustion engine according to the present invention is an internal combustion engine in which a piston reciprocates within a bore provided in a cylinder block and a connecting rod coupled to the piston transmits motive power to a crankshaft. The internal combustion engine includes an oil supply portion through which oil is injected from a connecting rod side of the piston to an inside and an outside of a skirt of the piston.

In the internal combustion engine configured in such a manner, the outside of the skirt can be cooled and the bore can be cooled indirectly. As a result, the internal combustion engine can be uniformly cooled.

Preferably, the piston has a pin boss having a piston pin attached, and oil is injected from the oil supply portion to a portion located above the pin boss in the outside of the skirt.

Preferably, oil is injected from the oil supply portion to a peripheral portion of the piston in the portion located above the pin boss. In this case, when oil is injected to the outside of the skirt, cooling of the bore can be maximized.

More preferably, a plurality of the oil supply portions are arranged symmetrically with respect to a center of the piston. In this case, the oil supply portion is arranged symmetrically with respect to a point (on a diagonal line), so that the temperature of the piston can be made uniform and the temperature of a ring groove can be reduced. As a result, fixation and the like of a ring can be prevented.

Preferably, the oil supply portion includes a first oil supply portion from which oil is injected to the inside of the skirt and a second oil supply portion from which oil is injected to the outside of the skirt. A first valve opening pressure at which the first oil supply portion starts oil injection is lower than a second valve opening pressure at which the second oil supply portion starts oil injection.

Preferably, the oil supply portion includes the second oil supply portion from which oil is injected to a region between the bores in the outside of the skirt and a third oil supply portion from which oil is injected to a cylinder block end in the outside of the skirt. The second valve opening pressure at which the second oil supply portion starts oil injection is lower than a third valve opening pressure at which the third oil supply portion starts oil injection.

BEST MODES FOR CARRYING OUT THE INVENTION

Figure 1:
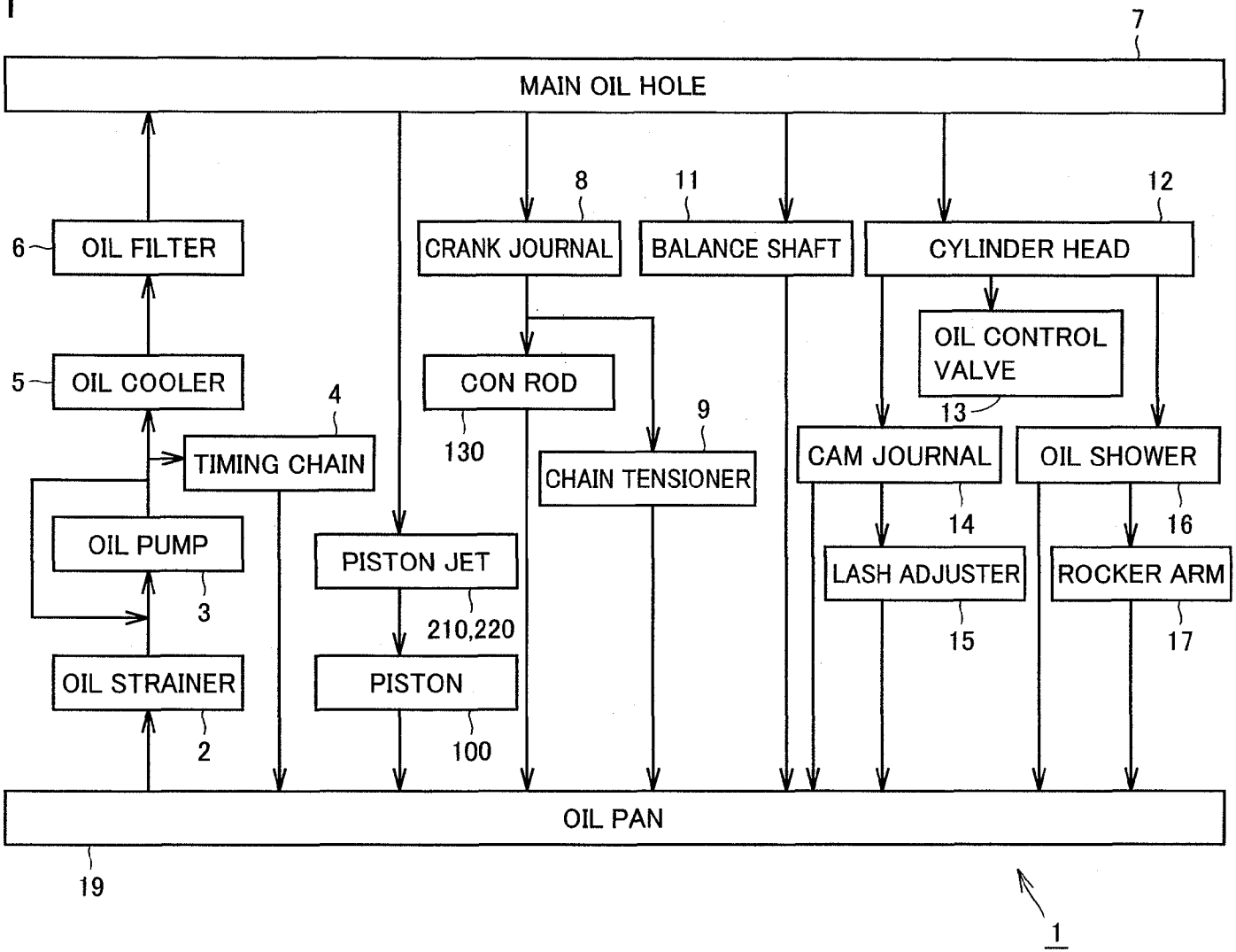
FIG. 1 is a diagram for explaining a hydraulic circuit of an internal combustion engine according to a first embodiment.

The embodiments of the present invention will be described hereinafter. In the following embodiments, the same or corresponding parts are represented by the same reference characters, and the description thereof will not be repeated. Each embodiment can also be combined.

First Embodiment

FIG. 1 is a diagram for explaining a hydraulic circuit of an internal combustion engine according to a first embodiment. Referring to FIG. 1, in the hydraulic circuit of an engine 1 serving as the internal combustion engine, oil is stored in an oil pan 19 provided at the lower part of an engine block. The oil stored in oil pan 19 is supplied to an oil pump 3 through an oil strainer 2 for removing foreign substances. Oil pump 3 is driven by motive power of the engine and pressurizes the oil. The pressurized oil is cooled in an oil cooler 5. The cooled oil is filtered by an oil filter 6. A part of the oil drained out of oil pump 3 lubricates a timing chain 4 and is returned to oil pan 19.

The oil having passed through oil filter 6 and having the oil pressure applied is supplied to a main oil hole 7. Main oil hole 7 extends to various parts in the engine. A part of the oil in main oil hole 7 is supplied to piston jets (oil jets) 210 and 220, and furthermore, injected toward a piston 100. The oil having cooled and lubricated piston 100 is returned to oil pan 19.

The oil supplied to main oil hole 7 is led to a crank journal 8 and lubricates crank journal 8. Furthermore, the oil having lubricated crank journal 8 lubricates a con rod (connecting rod) 130 and a chain tensioner 9, and is returned to oil pan 19.

The oil in main oil hole 7 lubricates a balance shaft 11, and then is returned to oil pan 19.

The oil in main oil hole 7 is supplied to a cylinder head 12. A part of the oil in cylinder head 12 lubricates a cam journal 14 and a lash adjuster 15, and is returned to oil pan 19. The oil in cylinder head 12 is also supplied to an oil control valve 13 and used to change the intake and/or exhaust valve timing.

Furthermore, the oil in cylinder head 12 is supplied to an oil shower 16 and a rocker arm 17, and then is returned to oil pan 19.

Figure 2:
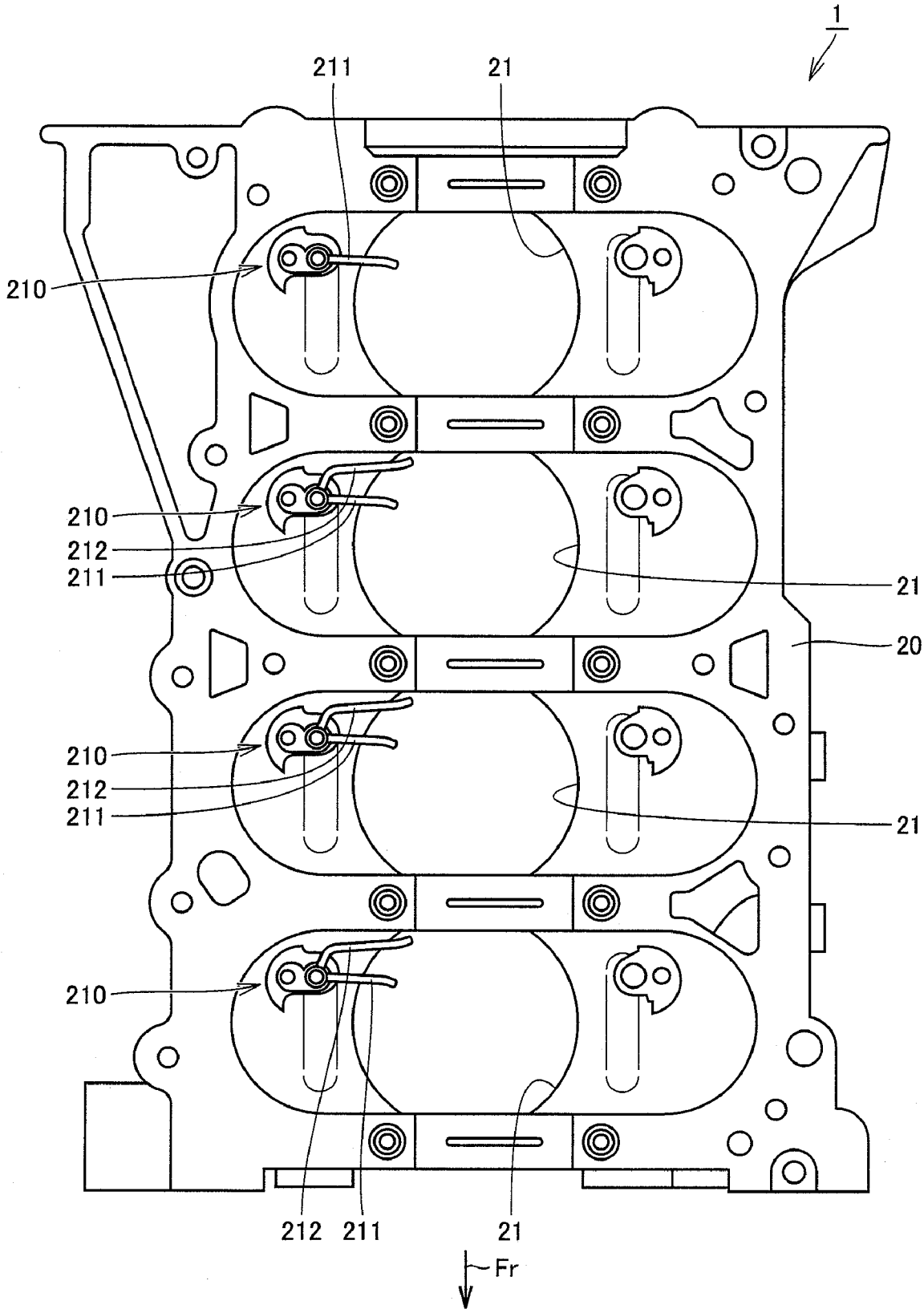
FIG. 2 is a bottom view of a cylinder block forming the internal combustion engine according to the first embodiment.

FIG. 2 is a bottom view of a cylinder block forming the internal combustion engine according to the first embodiment. Referring to FIG. 2, a cylinder block 20 is a metallic body and has a plurality of bores 21 provided to align in one direction. Although cylinder block 20 applied to an in-line four-cylinder type engine is shown in the present embodiment, cylinder block 20 may be applied to various types such as an in-line type, a parallel type, a V-type, a W-type, or a horizontally opposed type.

Cylinder block 20 is designed not only for a gasoline engine, but also for a diesel engine. Furthermore, any number of bores 21 may be provided in one cylinder block 20 if one or more bores 21 are provided.

A rear-side oil jet 210 serving as an oil supply portion is provided on the bottom surface side of cylinder block 20. Rear-side oil jet 210 has a front-side nozzle 211 and a rear-side nozzle 212, and oil is injected from each nozzle. It should be noted that all rear-side oil jets 210 do not need to have a plurality of nozzles. The fourth rear-side oil jet 210 from the front in FIG. 2 has only one front-side nozzle 211. In the present embodiment, the first to third rear-side (Rr) oil jets from the front have rear-side nozzles in order to promote cooling of a region between adjacent bores 21. As a result, cooling of a region between bores 21 is achieved.

Figure 3:
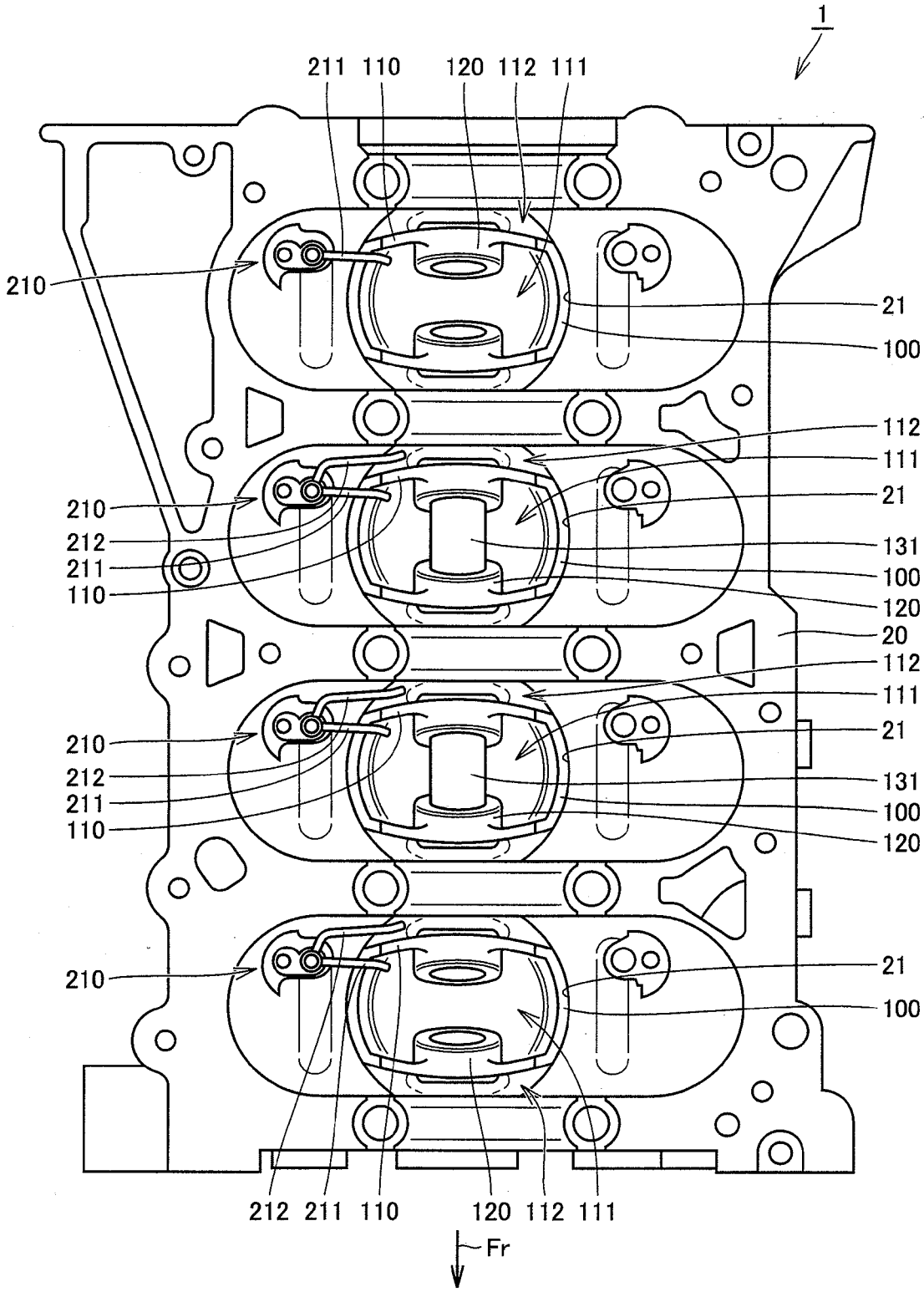
FIG. 3 is a bottom view of the cylinder block having pistons incorporated therein.

FIG. 3 is a bottom view of the cylinder block having pistons incorporated therein. Referring to FIG. 3, piston 100 is installed in each bore 21. Piston 100 has a skirt 110, and a pin boss 120 for attaching a piston pin 131 is provided at this skirt 110. Skirt 110 defines a skirt inner region 111 and a skirt outer region 112. Skirt inner region 111 refers to a region surrounded by skirt 110, and skirt outer region 112 refers to an external region that is not surrounded by skirt 110. Oil is injected from front-side nozzle 211 to skirt inner region 111, and from rear-side nozzle 212 to skirt outer region 112.

Pin boss 120 supports piston pin 131, and piston pin 131 is arranged between two pin bosses 120. Piston pin 131 is a member for coupling the connecting rod and piston 100. Although rear-side oil jet 210 is provided only on one side (on the left side in FIG. 3) in a direction in which the plurality of bores 21 are aligned in the present embodiment, the present invention is not limited thereto. The oil jet may be provided both on the right and left sides or only on one side in the direction in which bores 21 are aligned. Furthermore, although front-side nozzle 211 and rear-side nozzle 212 are provided in three bores 21 among the four cylinders, the present invention is not limited thereto. Front-side nozzle 211 and rear-side nozzle 212 may only be provided in any one of bores 21. In the other bores, any one of front-side nozzle 211 and rear-side nozzle 212 may be provided, and furthermore, the oil jet may not be provided.

Figure 4:
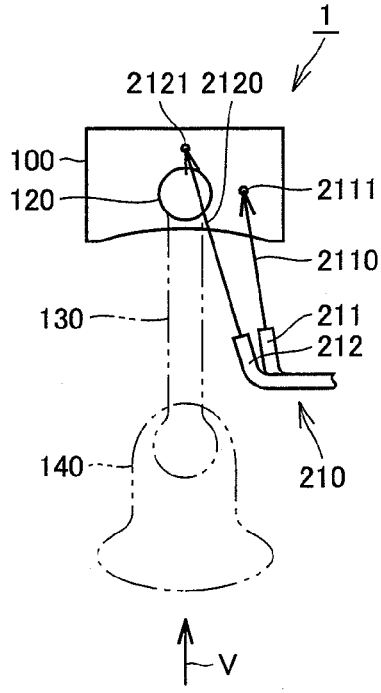
FIG. 4 is a schematic diagram of the piston at the top dead center.
Figure 5:
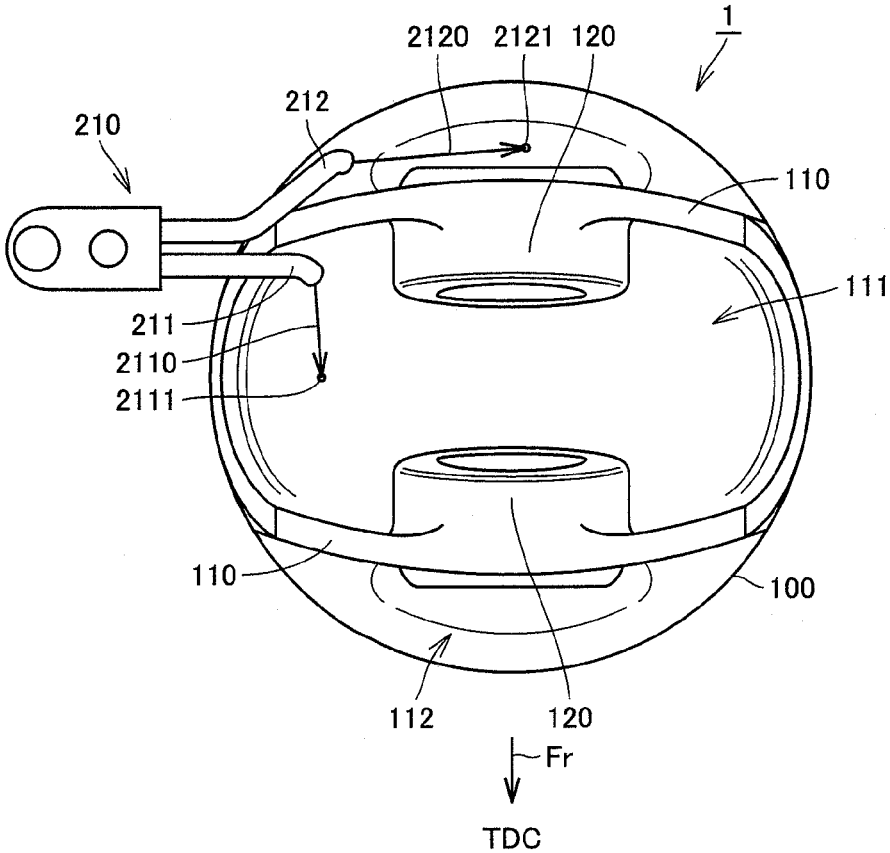
FIG. 5 is a bottom view of the piston as seen from the direction shown by an arrow V in FIG. 4.

FIG. 4 is a schematic diagram of the piston at the top dead center, and FIG. 5 is a bottom view of the piston as seen from the direction shown by an arrow V in FIG. 4. Referring to FIGS. 4 and 5, at the top dead center, piston 100 is situated at a position farthest from a crankshaft 140. In piston 100 at the top dead center, connecting rod 130 is arranged in parallel to the direction in which piston 100 reciprocates. Oil is injected from front-side nozzle 211 in the direction shown by an arrow 2110. As a result, the oil collides with the piston in an injection region 2111. Oil is injected from rear-side nozzle 212 in the direction shown by an arrow 2120. The injected oil collides with piston 100 in an injection region 2121. Injection region 2111 is situated in skirt inner region 111, and injection region 2121 is situated in skirt outer region 112. Furthermore, injection region 2121 is located above pin boss 120.

Bifurcated front-side nozzle 211 and rear-side nozzle 212 are arranged to straddle skirt 110, and oil is injected from front-side nozzle 211 and rear-side nozzle 212 to the inside and the outside of skirt 110, respectively. Although the piston is circular in the present embodiment, the piston is not necessarily limited to a perfect circle. The piston may be oval.

Figure 6:
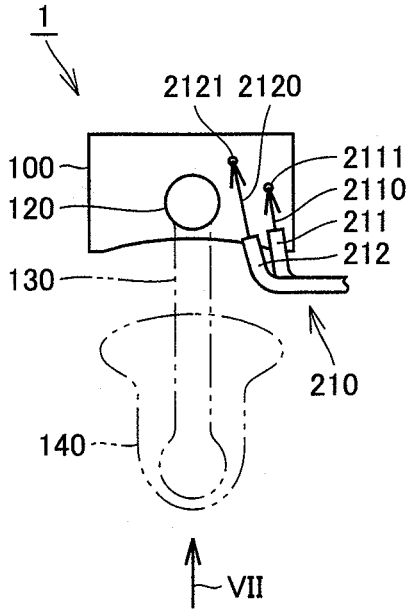
FIG. 6 is a schematic diagram of the piston at the bottom dead center.
Figure 7:
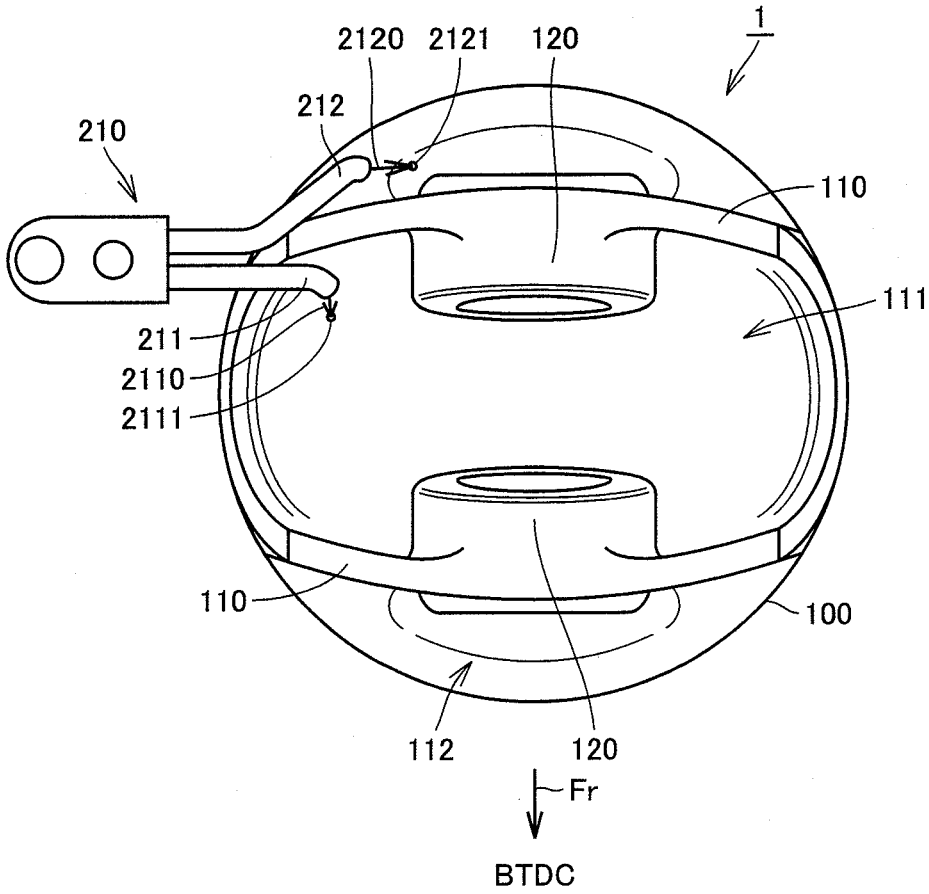
FIG. 7 is a bottom view of the piston as seen from the direction shown by an arrow VII in FIG. 6.

FIG. 6 is a schematic diagram of the piston at the bottom dead center. FIG. 7 is a bottom view of the piston as seen from the direction shown by an arrow VII in FIG. 6. Referring to FIGS. 6 and 7, at the bottom dead center, piston 100 comes closest to crankshaft 140. At the bottom dead center, oil is also injected from front-side nozzle 211 and rear-side nozzle 212 to piston 100 in the directions shown by arrows 2110 and 2120. The distance between front-side nozzle 211, rear-side nozzle 212 and piston 100 at the bottom dead center is shorter than that at the top dead center. Therefore, injection regions 2111 and 2121 are different from those at the top dead center. Specifically, injection regions 2111 and 2121 are located at positions close to front-side nozzle 211 and rear-side nozzle 212.

Engine 1 serving as the internal combustion engine according to the first embodiment is an internal combustion engine in which piston 100 reciprocates within bore 21 provided in cylinder block 20 and connecting rod 130 coupled to piston 100 transmits motive power to crankshaft 140. The internal combustion engine includes rear-side oil jet 210 serving as the oil supply portion through which oil is injected from the connecting rod 130 side of piston 100 to skirt inner region 111 located inside of skirt 110 of piston 100 and skirt outer region 112.

Piston 100 has pin boss 120 having piston pin 131 attached thereto, and oil is supplied from rear-side oil jet 210 onto pin boss 120.

In engine 1 configured in such a manner, oil is injected to skirt outer region 112 located outside of skirt 110 and skirt outer region 112 can be intentionally cooled. As a result, bore 21 close to skirt outer region 112 can be cooled.

Second Embodiment

Figure 8:
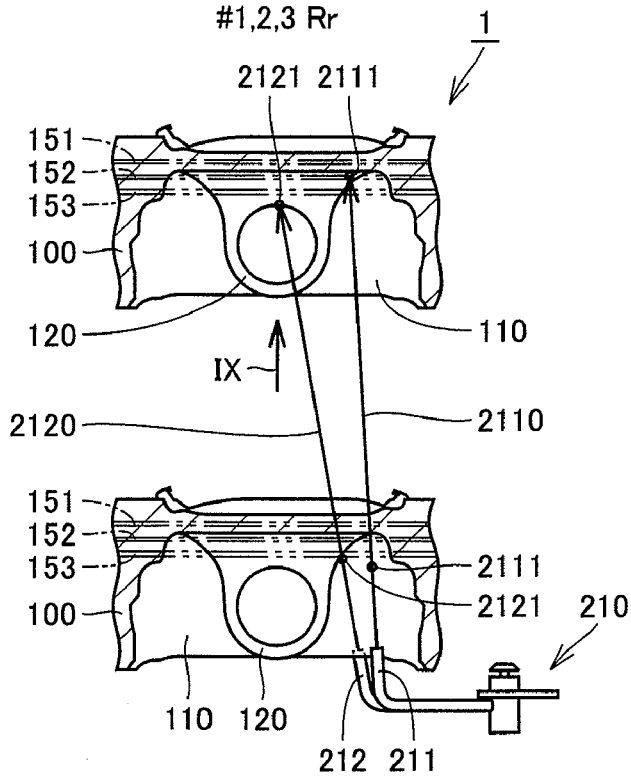
FIG. 8 is a cross-sectional view of a piston at the top dead center and at the bottom dead center in an internal combustion engine according to a second embodiment.
Figure 9:
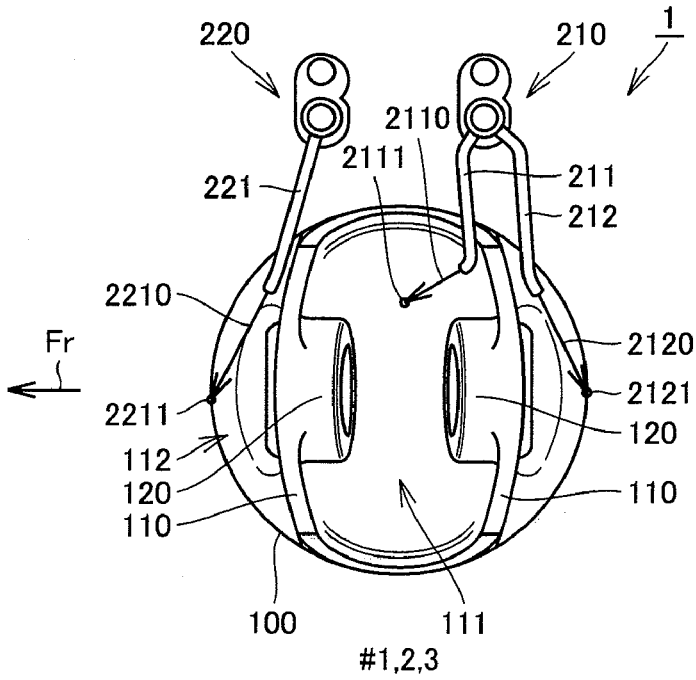
FIG. 9 is a bottom view of the piston at the top dead center as seen from the direction shown by an arrow IX in FIG. 8.

FIG. 8 is a cross-sectional view of a piston at the top dead center and at the bottom dead center in an internal combustion engine according to a second embodiment. FIG. 9 is a bottom view of the piston at the top dead center as seen from the direction shown by an arrow IX in FIG. 8. Referring to FIGS. 8 and 9, as shown in FIG. 9, an engine 1 according to the second embodiment is different from engine 1 according to the first embodiment in that front-side oil jet 220 and rear-side oil jet 210 serving as two oil supply portions are provided at one piston 100. Front-side oil jet 220 has one front-side nozzle 221. Oil is injected from front-side nozzle 221 toward the direction shown by an arrow 2210 and the oil collides with piston 100 in an injection region 2211. The oil collides in skirt outer region 112 in piston 100. Oil is injected from bifurcated front-side nozzle 211 and rear-side nozzle 212 in the directions shown by arrows 2110 and 2120 to skirt inner region 111 and skirt outer region 112, respectively.

It should be noted that symbols "#1, 2, 3" in the figure indicate the first to third pistons from the front. "#" is interpreted similarly in the other figures. For example, "#1" indicates the first piston from the front.

Although front-side oil jet 220 and rear-side oil jet 210 are provided in the same direction with respect to pin boss 120 in the present embodiment, the present invention is not limited thereto. The oil jets may be provided symmetrically to each other with respect to pin boss 120.

FIGS. 8 and 9 show the first, the second and third pistons from the front side in an in-line four cylinder. Furthermore, FIG. 8 shows only rear-side oil jet 210. Piston 100 has three piston ring grooves 151, 152 and 153, and piston rings are fitted into piston ring grooves 151, 152 and 153.

As shown in FIG. 8, injection regions 2111 and 2121 at the top dead center are different from those at the bottom dead center. This is because the directions shown by arrows 2110 and 2120 are inclined with respect to the direction in which piston 100 reciprocates.

Figure 10:
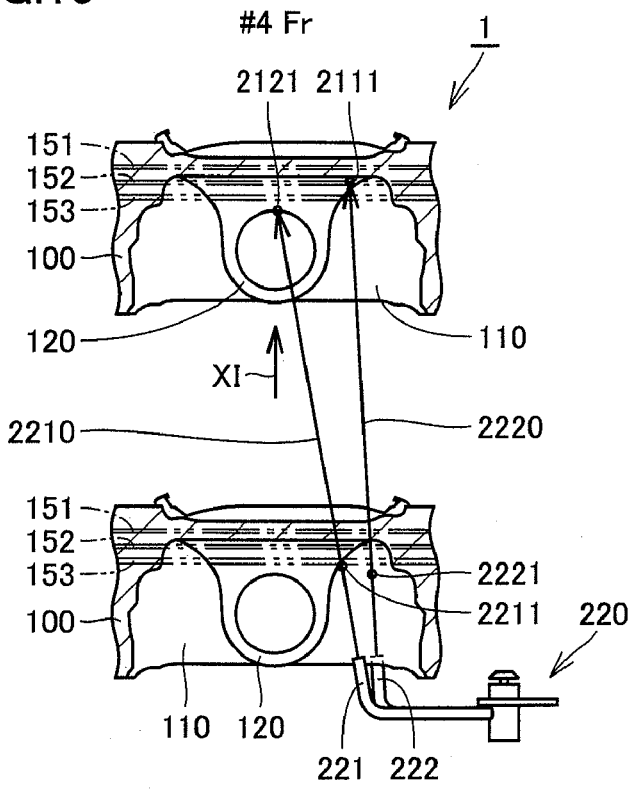
FIG. 10 is a cross-sectional view of the fourth piston from the front at the top dead center and at the bottom dead center in the in-line four-cylinder engine.
Figure 11:
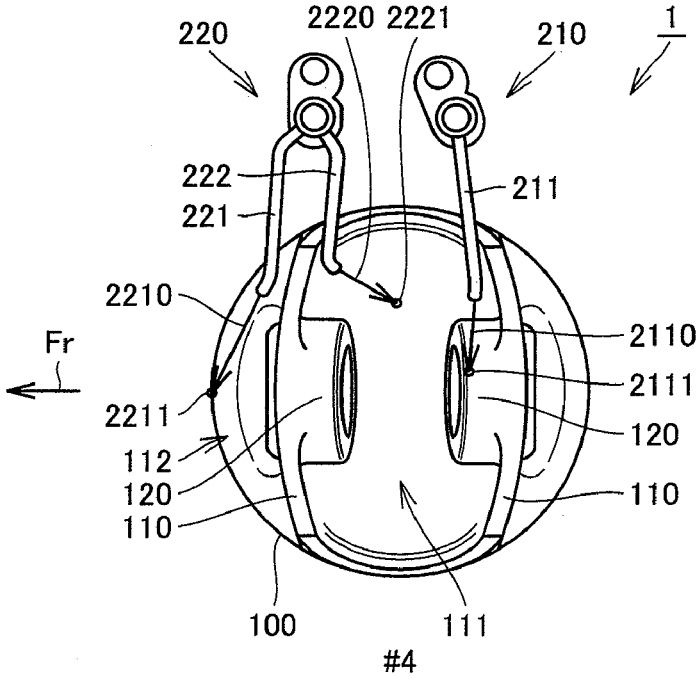
FIG. 11 is a bottom view of the piston at the top dead center as seen from the direction shown by an arrow XI in FIG. 10.

FIG. 10 is a cross-sectional view of the fourth piston from the front at the top dead center and at the bottom dead center in the in-line four-cylinder engine. FIG. 11 is a bottom view of the piston at the top dead center as seen from the direction shown by an arrow XI in FIG. 10. Referring to FIGS. 10 and 11, in the fourth piston, that is, the rearmost piston of the in-line four-cylinder type, front-side oil jet 220 has front-side nozzle 221 and a rear-side nozzle 222 serving as two nozzles, and rear-side oil jet 210 has only one front-side nozzle 211. This is because a front-side bore of the fourth piston is adjacent to the third piston and it is necessary to remove heat accumulated in this portion. In other words, front-side nozzle 221 shown in FIG. 11 is provided in order to remove heat between the third bore and the fourth bore. Oil injected from front-side nozzle 221 in the direction shown by arrow 2210 is directed to injection region 2211 located at an outer peripheral portion of piston 100. Since this injection region is close to the adjacent third piston from the front, a region between the third bore and the fourth bore can be cooled.

Figure 12:
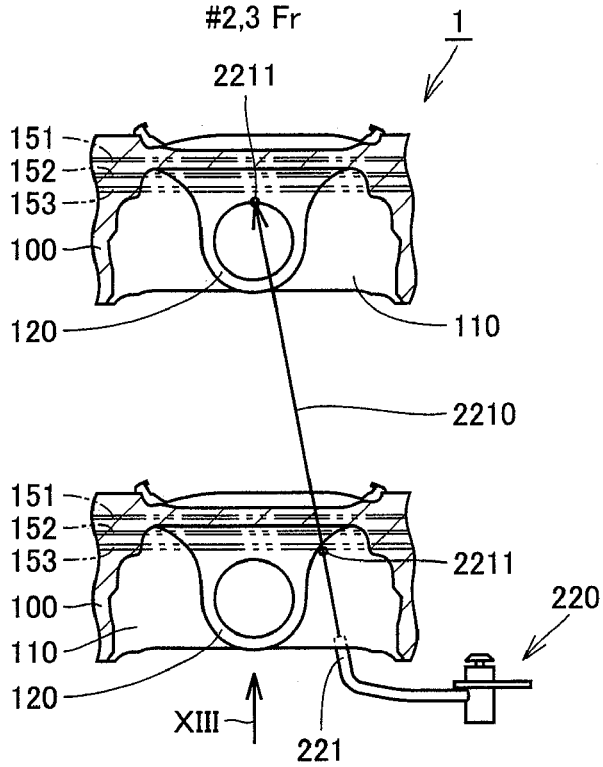
FIG. 12 is a cross-sectional view of the second or the third piston from the front at the top dead center and at the bottom dead center in the in-line four-cylinder engine.
Figure 13:
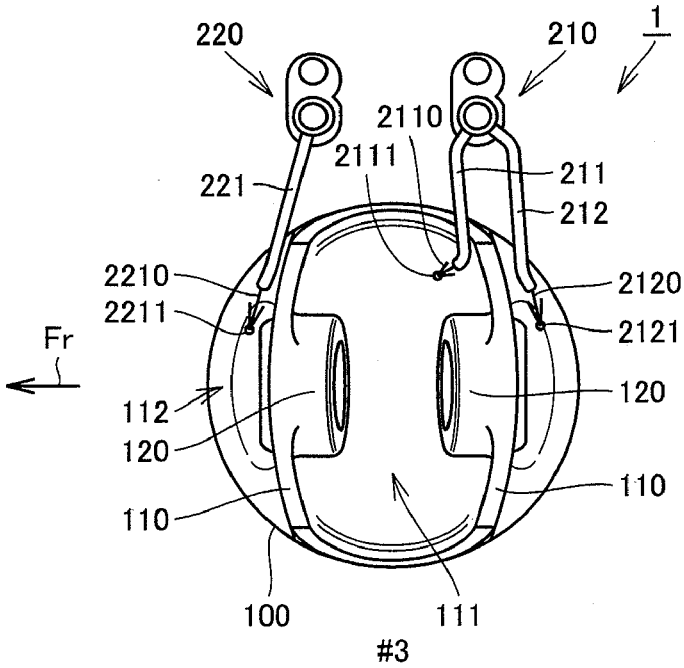
FIG. 13 is a bottom view of the piston at the bottom dead center as seen from the direction shown by an arrow XIII in FIG. 12.

FIG. 12 is a cross-sectional view of the second or the third piston from the front at the top dead center and at the bottom dead center in the in-line four-cylinder engine. Two pistons shown in the figure indicate the pistons located at the top dead center and at the bottom dead center, respectively. FIG. 13 is a bottom view of the piston at the bottom dead center as seen from the direction shown by an arrow XIII in FIG. 12.

Referring to FIGS. 12 and 13, oil is injected from front-side nozzle 221 of front-side oil jet 220 in the direction shown by arrow 2210. When piston 100 is at the top dead center, oil is injected to injection region 2211 near pin boss 120. On the other hand, when piston 100 is at the bottom dead center, oil is injected to injection region 2211 close to front-side nozzle 221. As shown in FIG. 13, oil is injected from front-side oil jet 220 and rear-side oil jet 210 toward piston 100 in the directions shown by arrows 2210, 2110 and 2120. The injected oil is directed to injection regions 2211, 2111 and 2121, and cools and lubricates these portions.

Figure 14:
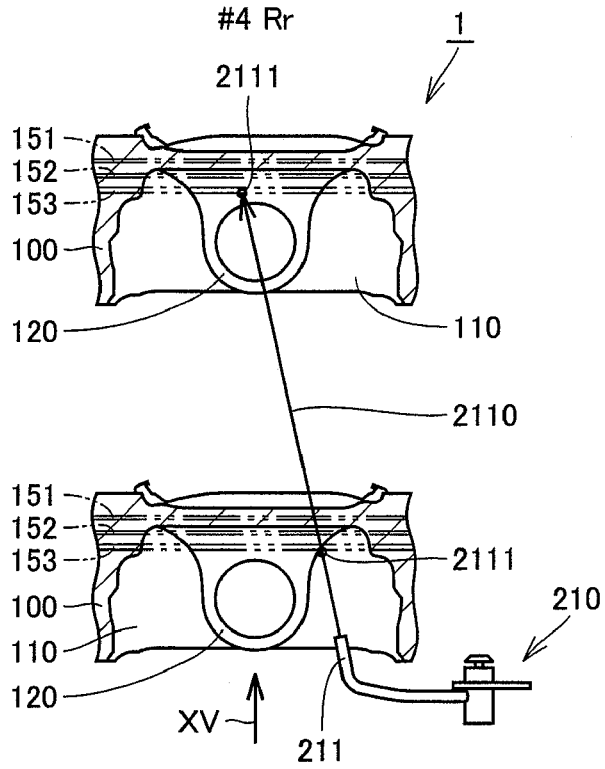
FIG. 14 is a cross-sectional view of the fourth piston from the front at the top dead center and at the bottom dead center in the in-line four-cylinder engine.
Figure 15:
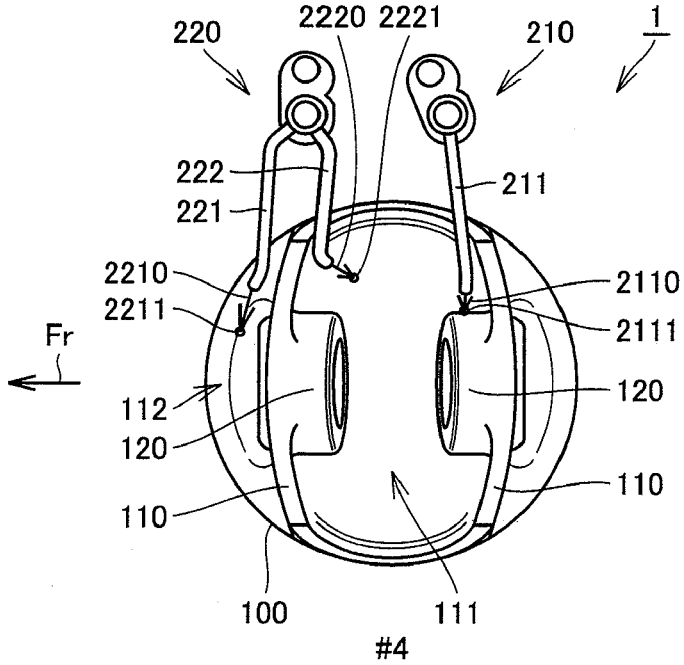
FIG. 15 is a bottom view of the piston at the bottom dead center as seen from the direction shown by an arrow XV in FIG. 14.

FIG. 14 is a cross-sectional view of the fourth piston from the front at the top dead center and at the bottom dead center in the in-line four-cylinder engine. FIG. 15 is a bottom view of the piston at the bottom dead center as seen from the direction shown by an arrow XV in FIG. 14.

Referring to FIGS. 14 and 15, oil is injected from front-side nozzle 221 and rear-side nozzle 222 of front-side oil jet 220 as well as front-side nozzle 211 of rear-side oil jet 210 in the directions shown by arrows 2210, 2220 and 2110, respectively. As a result, the oil is injected to injection regions 2211, 2221 and 2111, and these regions are cooled and lubricated. As shown in FIG. 14, the position of injection region 2111 when piston 100 is at the top dead center is different from that when piston 100 is at the bottom dead center.

Figure 16:
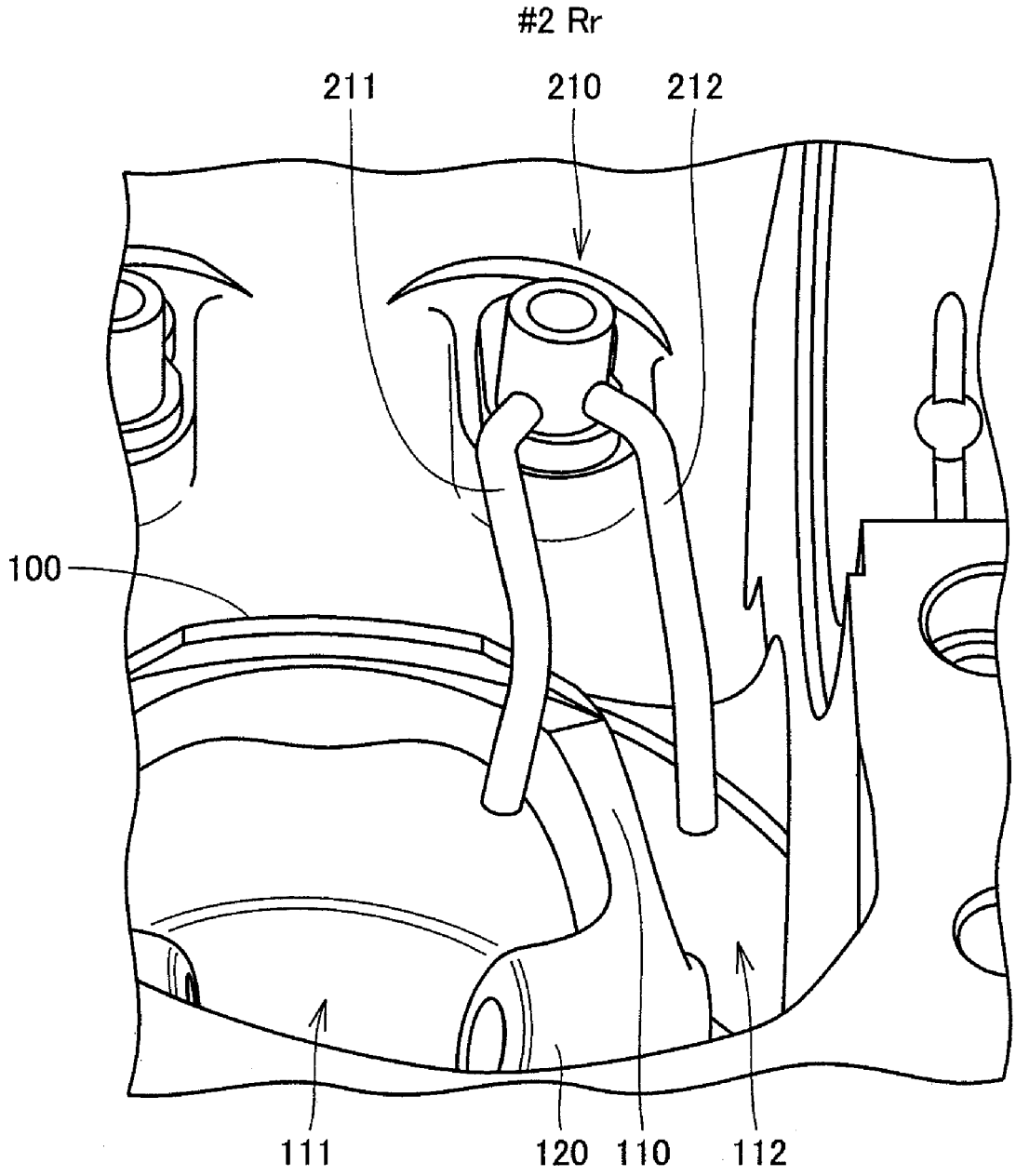
FIG. 16 is a perspective view of a rear-side oil jet of the second piston from the front in an enlarged manner.

FIG. 16 is a perspective view of the rear-side oil jet of the second piston from the front in an enlarged manner. Referring to FIG. 16, rear-side oil jet 210 has front-side nozzle 211 and rear-side nozzle 212 extending in a bifurcated manner. Oil is supplied to front-side nozzle 211 and rear-side nozzle 212, and the oil can be injected from each nozzle. When piston 100 is located at the bottom dead center, front-side nozzle 211 and rear-side nozzle 212 are arranged in skirt inner region 111 located inside of skirt 110 and skirt outer region 112 located outside of skirt 110 with skirt 110 interposed therebetween. The length of front-side nozzle 211 and rear-side nozzle 212 may be substantially equal to each other, or may be different from each other. Furthermore, front-side nozzle 211 and rear-side nozzle 212 may have a constant inner diameter. The inner diameter may be decreased toward the tip, or may be increased toward the tip.

Figure 17:
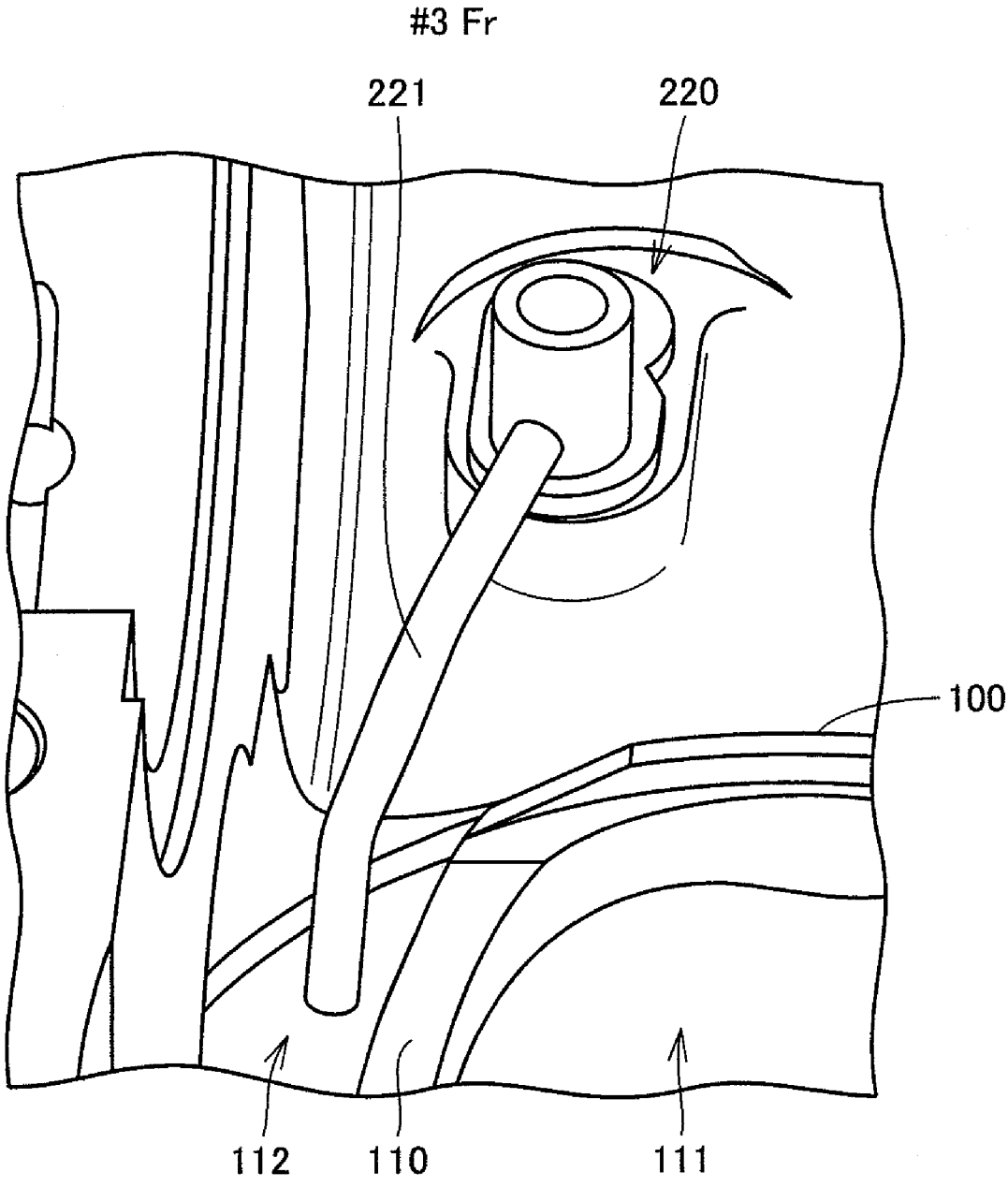
FIG. 17 is a perspective view of a front-side oil jet of the third piston from the front in an enlarged manner.

FIG. 17 is a perspective view of the front-side oil jet of the third piston from the front in an enlarged manner. Referring to FIG. 17, front-side oil jet 220 has front-side nozzle 221. Oil injected from front-side nozzle 221 is directed to skirt outer region 112. This directed oil cools piston 100 and also enters between piston 100 and the bore to lubricate piston 100. Furthermore, the oil is also directed to the pin boss, so that motion of the connecting rod operating within the pin boss is smoothed.

Figure 18:
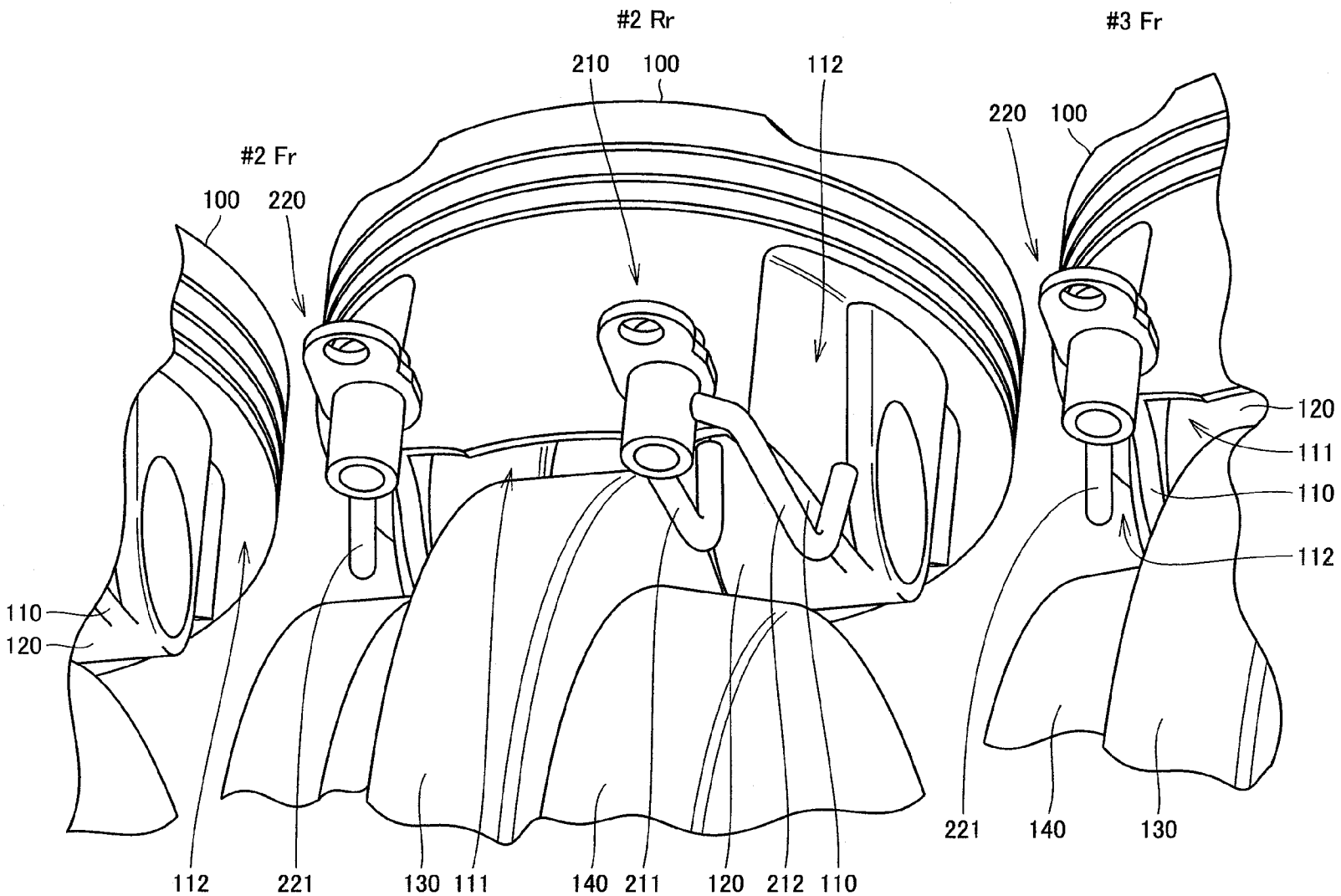
FIG. 18 is a perspective view of a plurality of oil jets.

FIG. 18 is a perspective view of a plurality of oil jets. Referring to FIG. 18, front-side oil jet 220 and rear-side oil jet 210 are arranged on the lower side of piston 100. Front-side oil jet 220 and rear-side oil jet 210 are arranged on the upper side of crankshaft 140 and on the lower side of piston 100. Although front-side oil jet 220 and rear-side oil jet 210 are provided at the same height in the present embodiment, front-side oil jet 220 and rear-side oil jet 210 may be provided at the different height. In this case, any one of front-side oil jet 220 and rear-side oil jet 210 is provided at a higher position, and the other is provided at a lower position. Skirt 110 has a cylindrical portion and a flat portion, and the pin boss is provided at the flat portion. The cylindrical portion is shaped along a wall of the bore. Skirt 110 is thickened at the flat portion in order to provide the pin boss.

Figure 19:
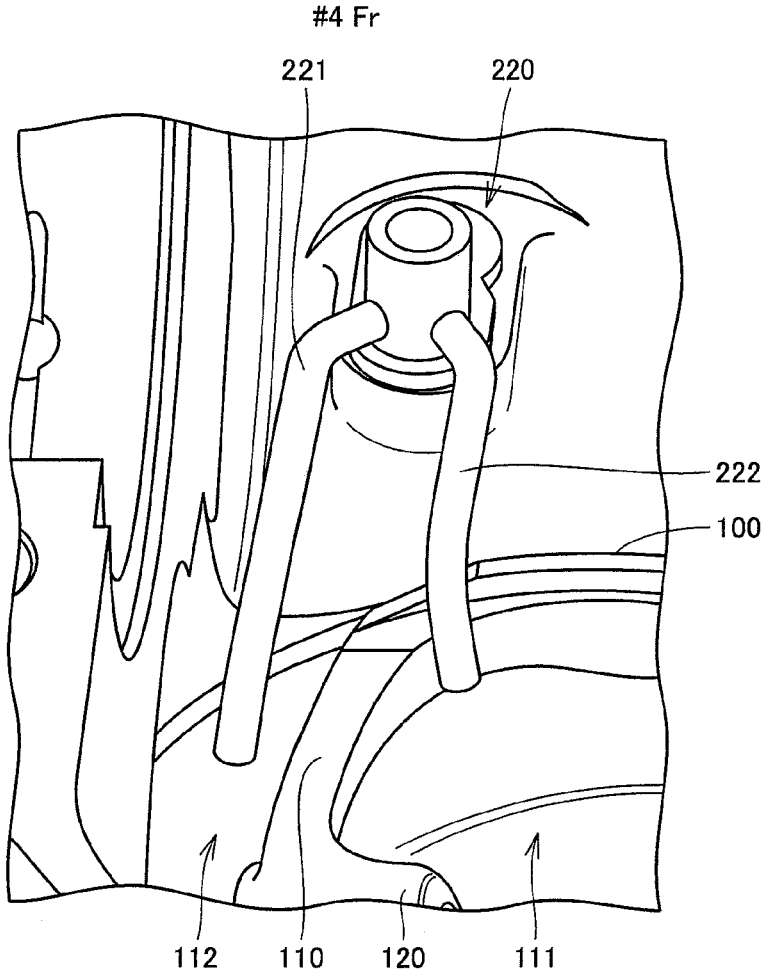
FIG. 19 is a perspective view of an oil jet from which oil is supplied to the fourth piston from the front, in an enlarged manner.
Figure 20:
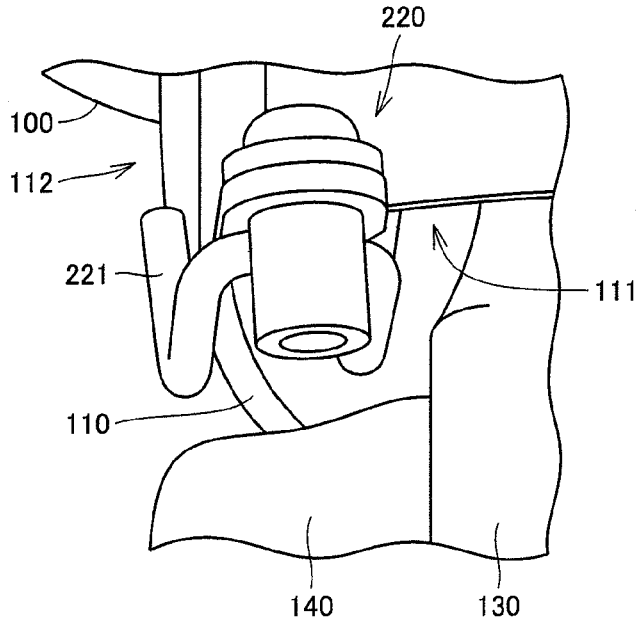
FIG. 20 is a perspective view of the oil jet from which oil is supplied to the fourth piston from the front, in an enlarged manner.

FIGS. 19 and 20 are perspective views of the oil jet from which oil is supplied to the fourth piston from the front, in an enlarged manner. Referring to FIGS. 19 and 20, since the fourth piston from the front is adjacent to the third piston from the front, front-side nozzle 221 is provided in order to cool the region between these pistons. Oil injected from front-side nozzle 221 is directed to skirt outer region 112 to cool the bore, and also lubricate piston 100.

Figure 21:
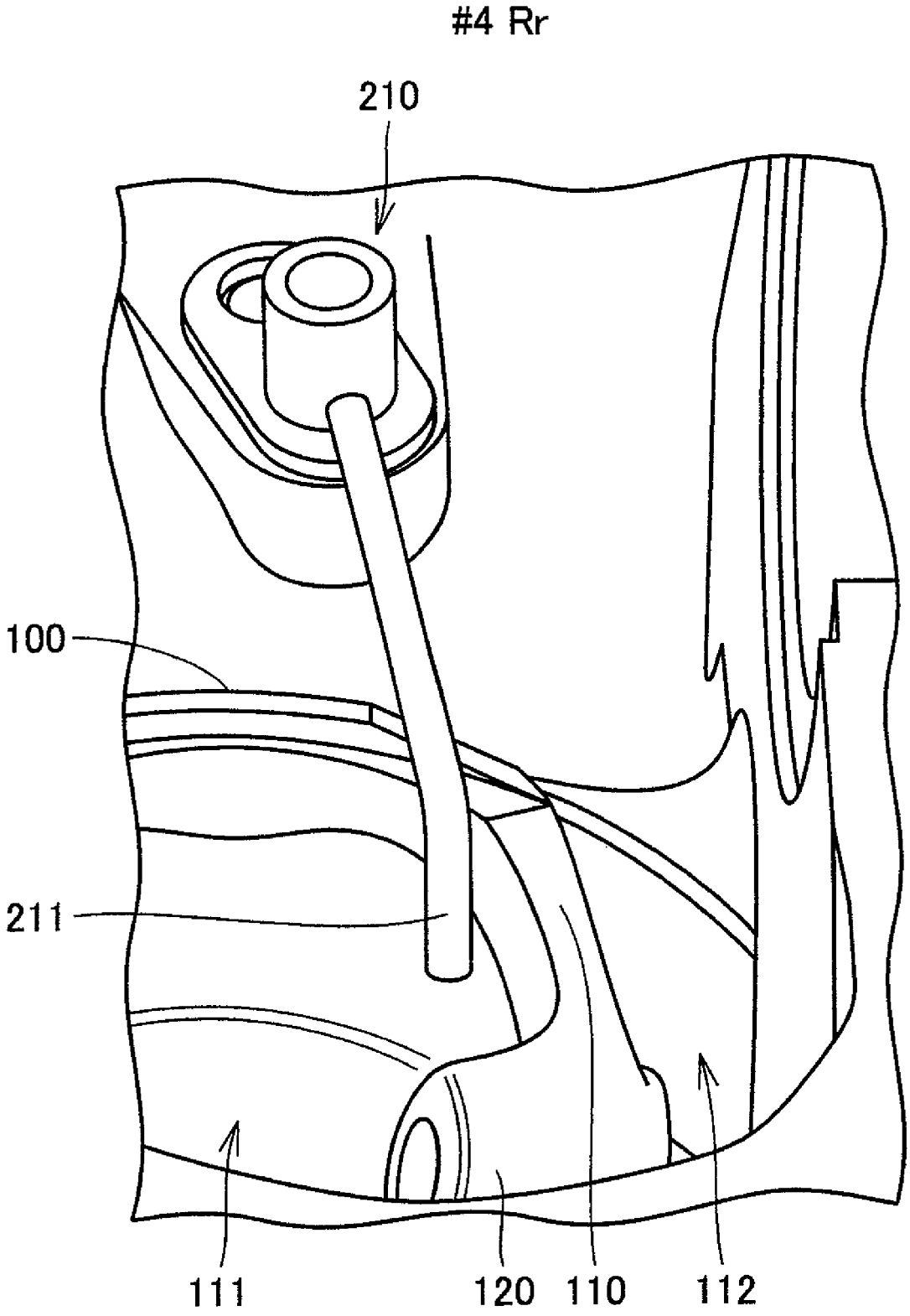
FIG. 21 is a perspective view of a rear-side oil jet of the fourth piston from the front in an enlarged manner.
Figure 22:
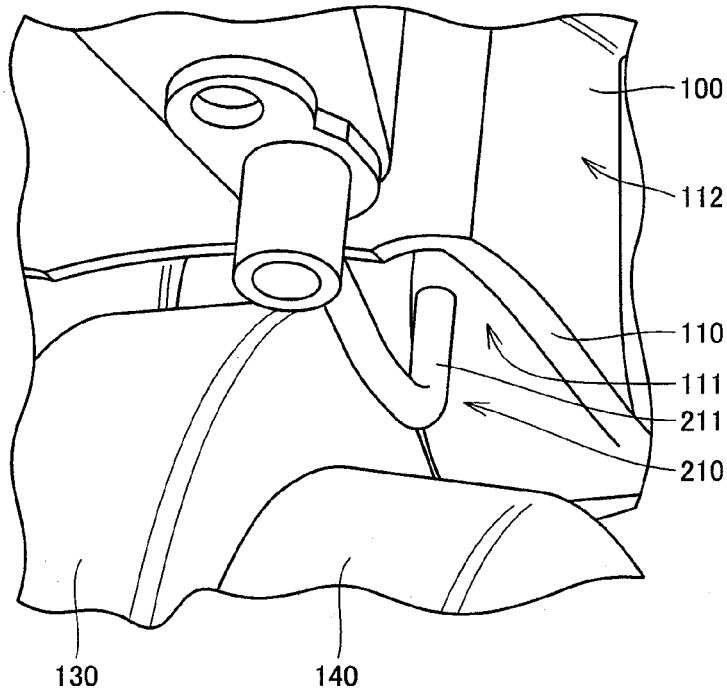
FIG. 22 is a perspective view of the rear-side oil jet of the fourth piston from the front in an enlarged manner.

FIGS. 21 and 22 are perspective views of the rear-side oil jet of the fourth piston from the front in an enlarged manner. Referring to FIGS. 21 and 22, oil is injected from front-side nozzle 211 to skirt inner region 111. Front-side nozzle 211 is arranged at a position where front-side nozzle 211 does not contact crankshaft 140 and connecting rod 130.

Third Embodiment

Figure 23:
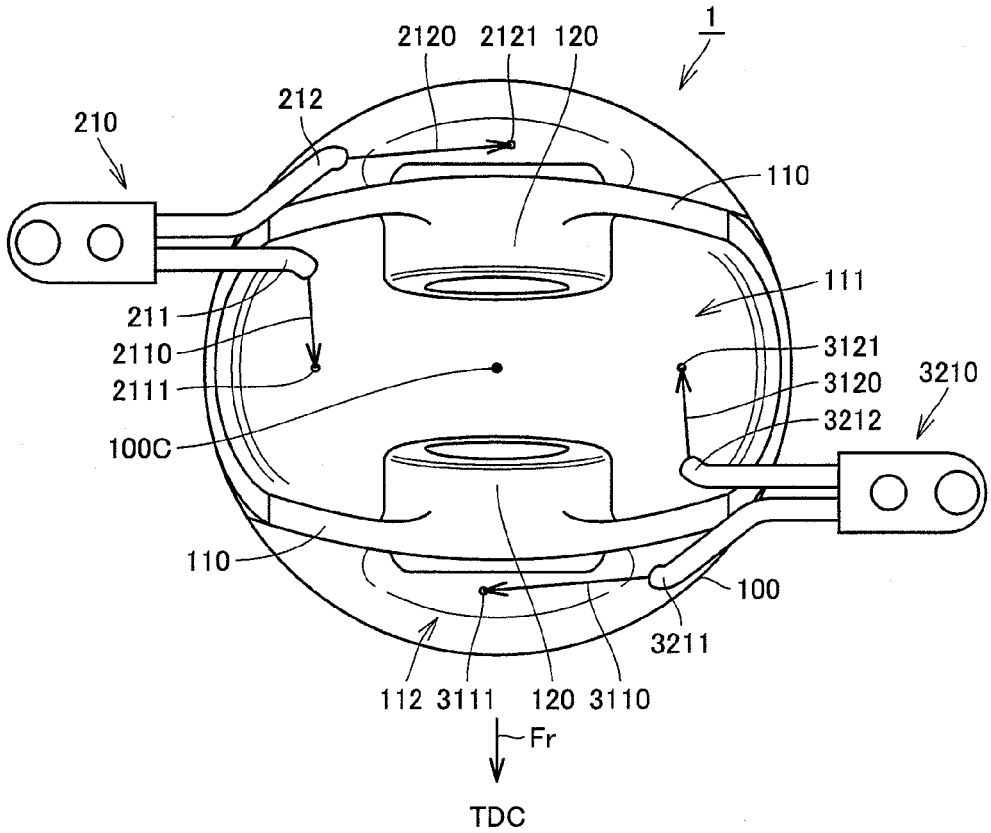
FIG. 23 is a bottom view of an internal combustion engine according to a third embodiment.

FIG. 23 is a bottom view of an internal combustion engine according to a third embodiment. Referring to FIG. 23, in an engine 1 according to the third embodiment, rear-side oil jet 210 and a front-side oil jet 3210 are arranged symmetrically with respect to a center point 100C of piston 100. Front-side oil jet 3210 has a front-side nozzle 3211 and a rear-side nozzle 3212. Oil is injected from the respective nozzles in the directions shown by arrows 3110 and 3120 to injection regions 3111 and 3121.

In such engine 1, the inside thereof can be cooled more uniformly.

Fourth Embodiment

Figure 24:
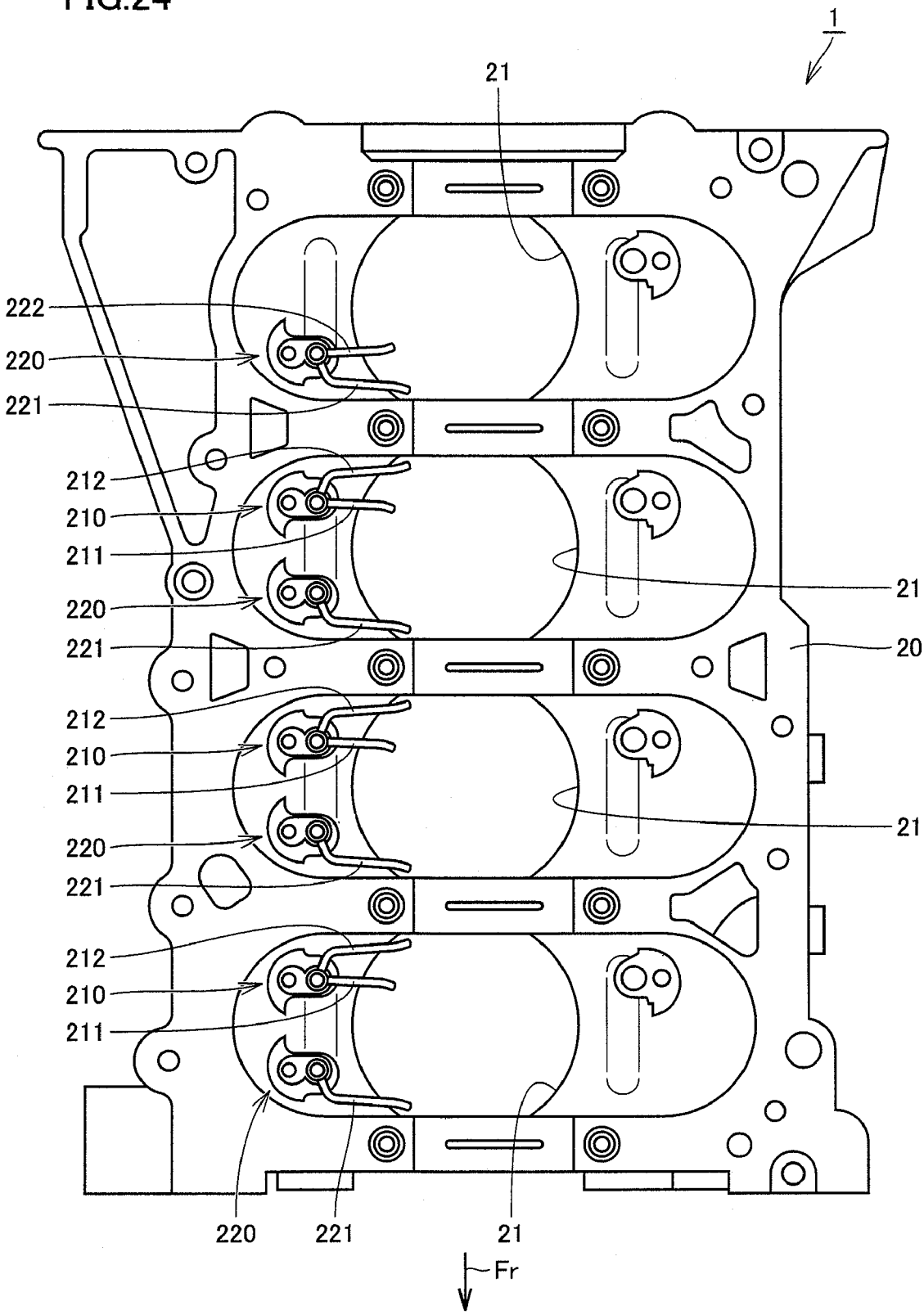
FIG. 24 is a bottom view of a cylinder block forming an internal combustion engine according to a fourth embodiment.

FIGS. 24 to 27 are bottom views of a cylinder block forming an internal combustion engine according to a fourth embodiment. In FIG. 24, front-side oil jet 220 having front-side nozzle 221 as well as rear-side oil jet 210 having front-side nozzle 211 and rear-side nozzle 212 are provided in the first to third bores 21 from the front. Front-side oil jet 220 having front-side nozzle 221 and rear-side nozzle 222 is provided in the fourth bore 21 from the front.

Figure 25:
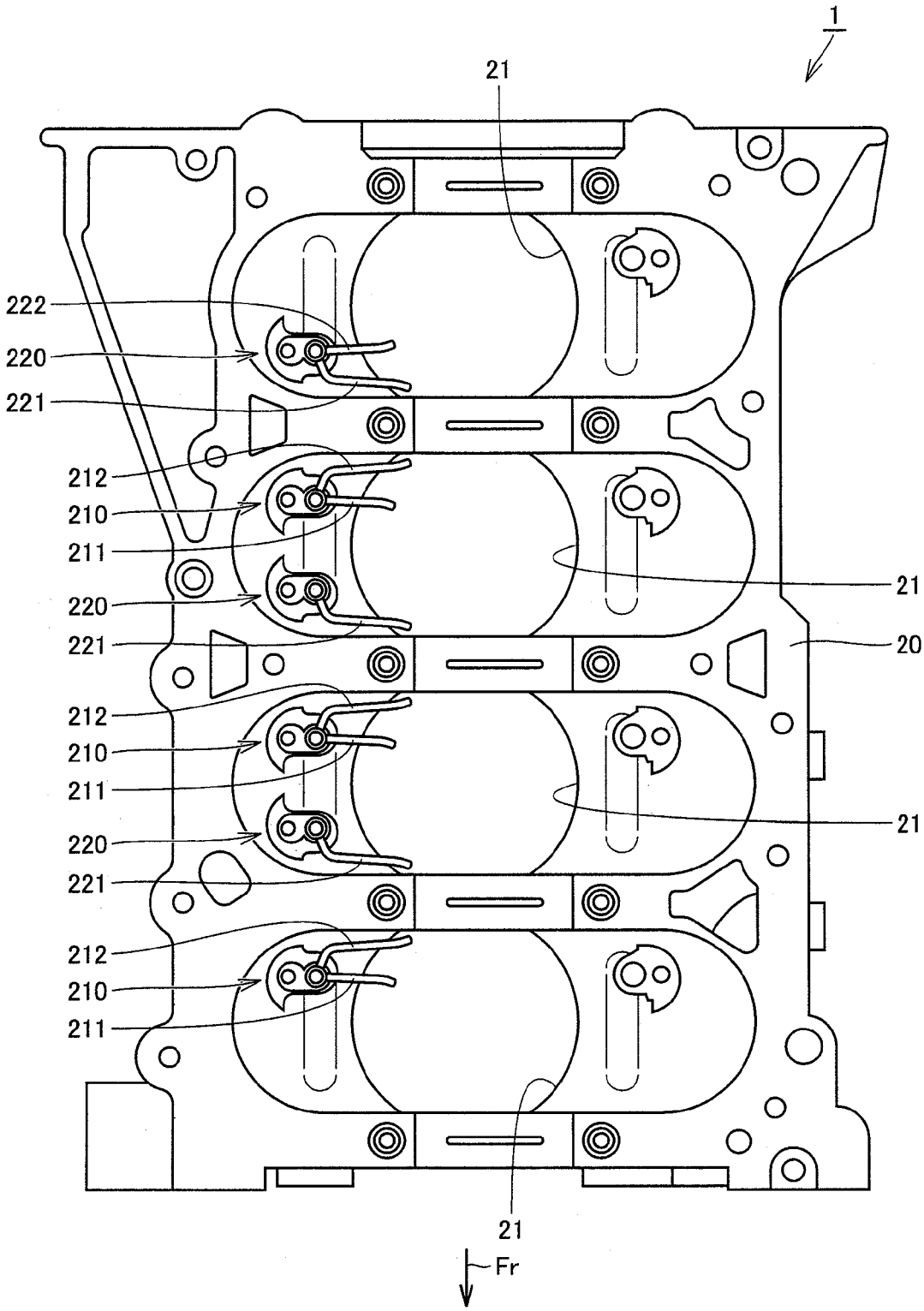
FIG. 25 is a bottom view of a cylinder block forming the internal combustion engine according to the fourth embodiment.

In FIG. 25, rear-side oil jet 210 having front-side nozzle 211 and rear-side nozzle 212 is provided in the first bore 21 from the front. Front-side oil jet 220 having front-side nozzle 221 as well as rear-side oil jet 210 having front-side nozzle 211 and rear-side nozzle 212 are provided in the second to third bores 21 from the front. Front-side oil jet 220 having front-side nozzle 221 and rear-side nozzle 222 is provided in the fourth bore 21 from the front.

Figure 26:
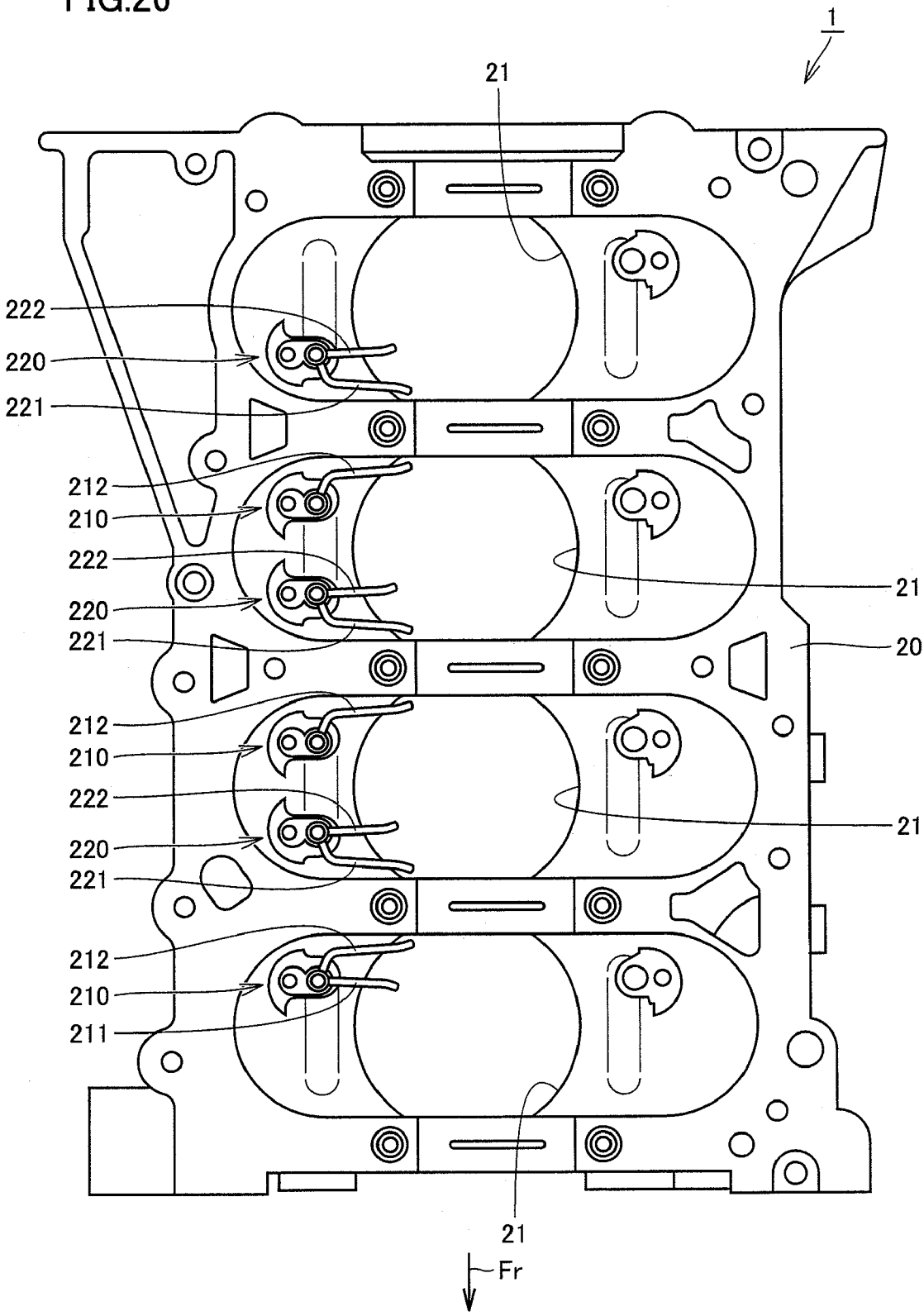
FIG. 26 is a bottom view of a cylinder block forming the internal combustion engine according to the fourth embodiment.

In FIG. 26, rear-side oil jet 210 having front-side nozzle 211 and rear-side nozzle 212 is provided in the first bore 21 from the front. Front-side oil jet 220 having front-side nozzle 221 and rear-side nozzle 222 as well as rear-side oil jet 210 having rear-side nozzle 212 are provided in the second to third bores 21 from the front. Front-side oil jet 220 having front-side nozzle 221 and rear-side nozzle 222 is provided in the fourth bore 21 from the front.

Figure 27:
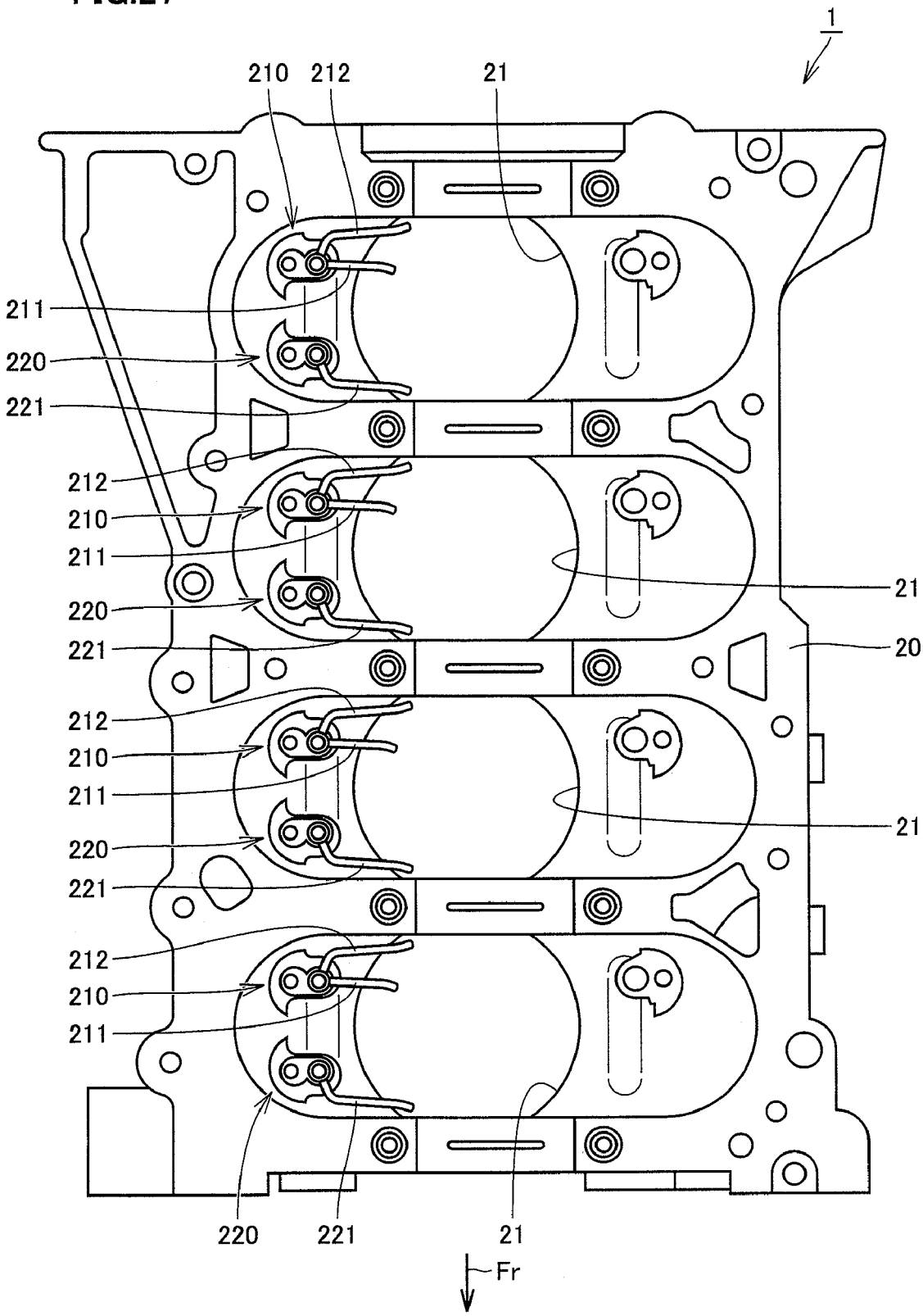
FIG. 27 is a bottom view of a cylinder block forming the internal combustion engine according to the fourth embodiment.

In FIG. 27, front-side oil jet 220 having front-side nozzle 221 as well as rear-side oil jet 210 having front-side nozzle 211 and rear-side nozzle 212 are provided in the first to fourth bores 21 from the front.

An engine 1 configured in such a manner also has an effect similar to those of engines 1 according to the first to third embodiments.

Fifth Embodiment

Figure 28:
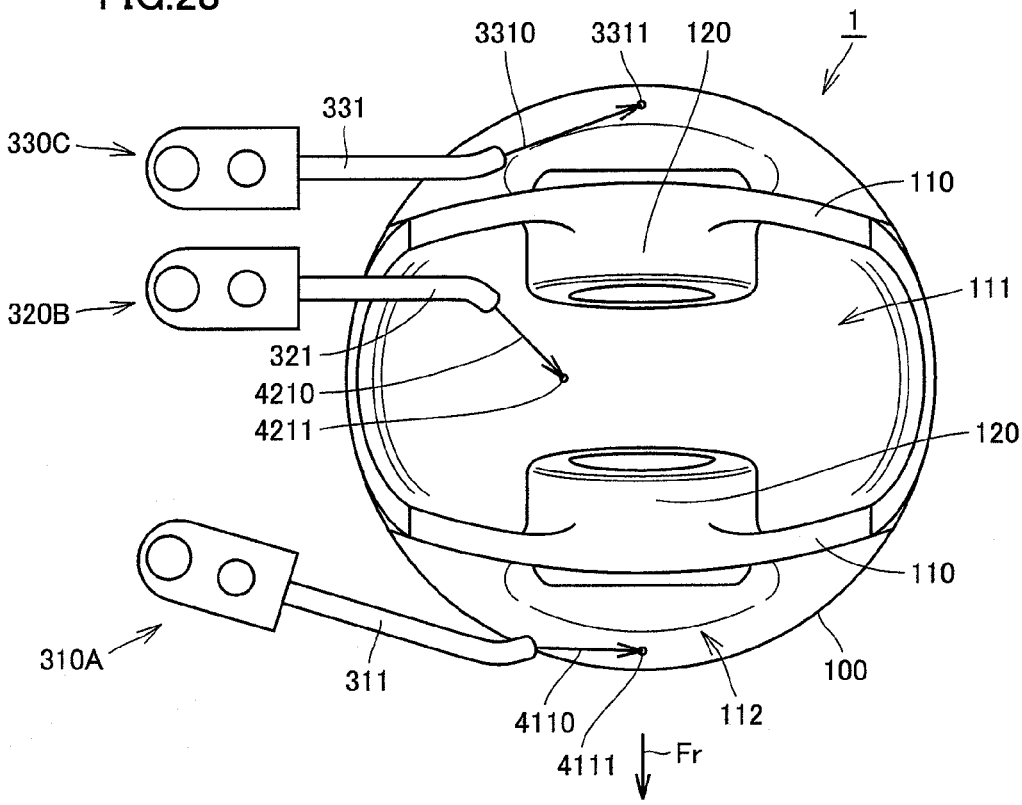
FIG. 28 is a bottom view of a piston and an oil jet in an internal combustion engine according to a fifth embodiment of the present invention.

FIG. 28 is a bottom view of a piston and an oil jet in an internal combustion engine according to a fifth embodiment of the present invention. Referring to FIG. 28, in an engine 1 serving as the internal combustion engine according to the fifth embodiment of the present invention, three oil jets are provided. Oil jets 310A, 320B and 330C are attached to a cylinder block with a predetermined spacing therebetween, respectively, and oil jets 310A, 320B and 330C have nozzles 311, 321 and 331, respectively. Oil is injected from nozzles 311 and 331 to skirt outer region 112, and from nozzle 321 toward skirt inner region 111. The oil injected from nozzle 311 moves in the direction shown by an arrow 4110 and reaches an injection region 4111. Injection region 4111 serving as a point to which the oil is directed is located at an edge of the outer circumference of piston 100. Furthermore, injection region 4111 is situated on the cylinder block end side.

An injection region 4211 is situated in skirt inner region 111 and is a region in piston 100 where the temperature thereof is especially increased. The oil injected from nozzle 321 moves in the direction shown by an arrow 4210 and reaches injection region 4211.

Although an injection region 3311 is situated at an outer circumferential portion of piston 100, injection region 3311 is not located at the cylinder block end but in a region between the bores, unlike injection region 4111. The oil injected from nozzle 331 moves in the direction shown by an arrow 3310 and reaches injection region 3311.

In other words, piston 100 shown in FIG. 28 is a piston of the first cylinder located at the cylinder block end. The cylinder block end is situated near injection region 4111.

Oil jet 320B from which oil is injected to the top surface of the piston requires rapid cooling. Therefore, the valve opening pressure of oil jet 320B (the minimum oil pressure that is necessary for oil jet 320B to start oil injection) is set lower than those of oil jets 310A and 330C.

On the other hand, in oil jets 310A and 330C, the valve opening pressure (the minimum oil pressure required to start oil injection) of each of oil jets 310A and 330C is higher than that of oil jet 320B in the center. In the case where oil is injected from oil jets 310A and 330C to the region between the bores, the oil may only be injected when the maximum torque point is exceeded, for example, in order to reduce the temperature of the region between the bores. In the case where oil is injected from oil jets 310A and 330C toward the cylinder block end, the oil may only be injected, for example, only at the maximum output point because the temperature of the bores at the end is low. Therefore, the valve opening pressure in this case can be set even higher than that in the case where the oil is injected to the region between the bores. As shown in FIG. 28, in the case where oil is injected from oil jet 310A to the cylinder block end, and oil is injected from oil jet 330C to the region between the bores, oil jet 310A has the highest valve opening pressure, oil jet 330C has the second highest valve opening pressure, and oil jet 320B has the lowest valve opening pressure.

Figure 29:
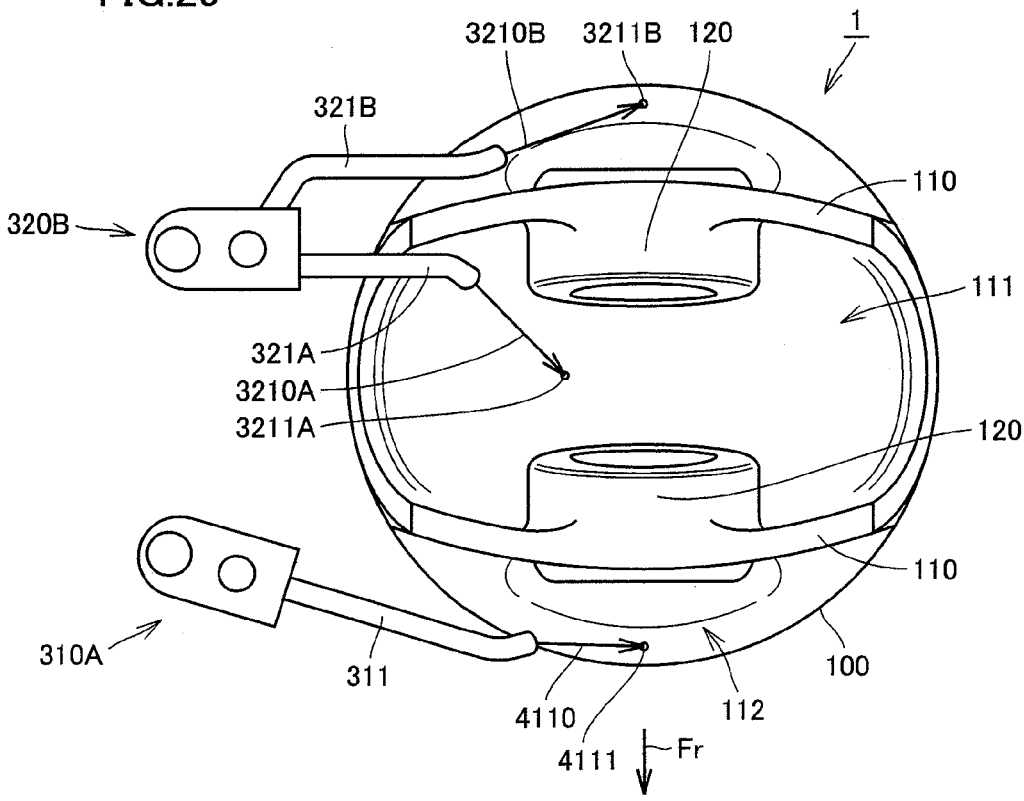
FIG. 29 is a bottom view of a piston and an oil jet in an internal combustion engine according to another aspect.

FIG. 29 is a bottom view of a piston and an oil jet in an internal combustion engine according to another aspect. Referring to FIG. 29, a nozzle of oil jet 320B may be configured to be bifurcated so that oil jet 320B has two nozzles 321A and 321B. In this case, the valve opening pressure of oil jet 320B becomes lower than that of oil jet 31A. As a result, it is more likely to inject oil from nozzle 321A, and oil is injected from nozzle 321A before oil is injected from nozzle 311.

The oil injected from nozzle 321B moves in the direction shown by an arrow 3210B and reaches an injection region 3211B. The oil injected from nozzle 321A moves in the direction shown by an arrow 3210A and reaches injection region 3211A. It should be noted that piston 100 shown in FIG. 29 is a piston of the second and third cylinders (a piston located in the central portion of the cylinder block) in the case of a four-cylinder engine.

Figure 30:
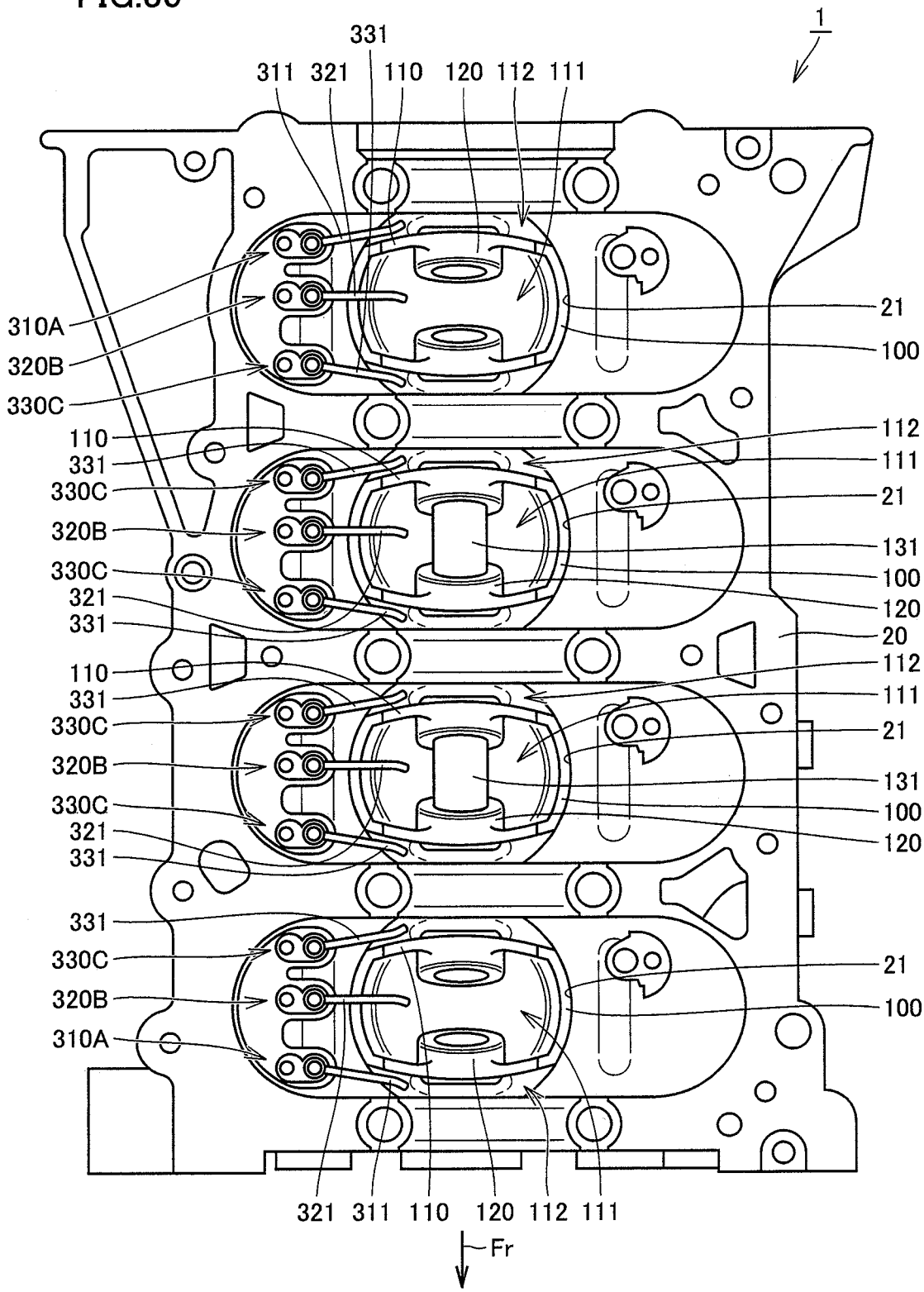
FIG. 30 is a bottom view of a cylinder block having the oil jets according to the fifth embodiment of the present invention attached thereto.

FIG. 30 is a bottom view of a cylinder block having the oil jets according to the fifth embodiment of the present invention attached thereto. Referring to FIG. 30, in an in-line four-cylinder type engine, for example, arrangement of the oil jets can be changed in various ways in the first piston (#1) to the fourth piston (#4). Specifically, in order to cool the first and fourth pistons, three types of oil jets 310A, 320B and 330C are used. This is because, in first piston 100 and fourth piston 100, oil jet 320B having the lowest valve opening pressure to inject oil to the top surface of the piston, oil jet 310A used to cool the cylinder block end where the temperature thereof is not so increased and having the highest valve opening pressure, and oil jet 330C cooling the region between the bores and having the medium valve opening pressure are used together.

On the other hand, in the second and third pistons, oil jet 320B having the lowest valve opening pressure to cool the top portion of the piston, and oil jet 330C having the medium valve opening pressure to cool the region between the bores are used.

It should be noted that provision of oil jet 310A for cooling the cylinder block end is not necessarily required.

It should be noted that oil jet 320B may have the lowest valve opening pressure, oil jet 310A may have the highest valve opening pressure, and oil jet 330C may have the medium valve opening pressure.

Figure 31:
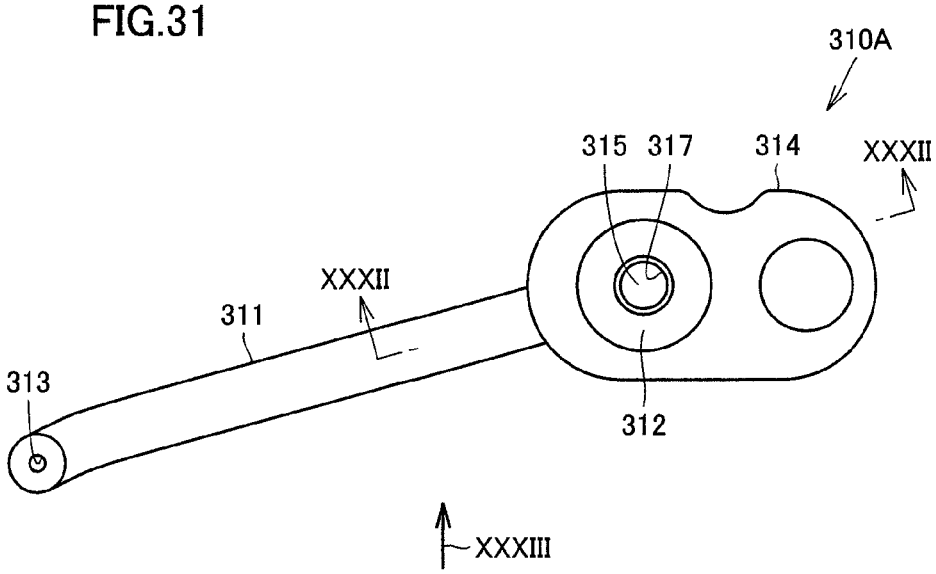
FIG. 31 is a plan view of the oil jet according to the fifth embodiment of the present invention.
Figure 32:
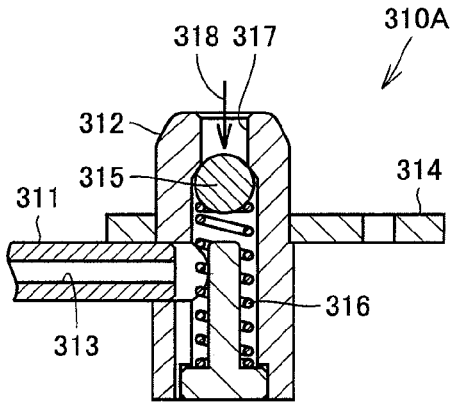
FIG. 32 is a cross-sectional view of the oil jet taken along line XXXII-XXXII in FIG. 31.
Figure 33:
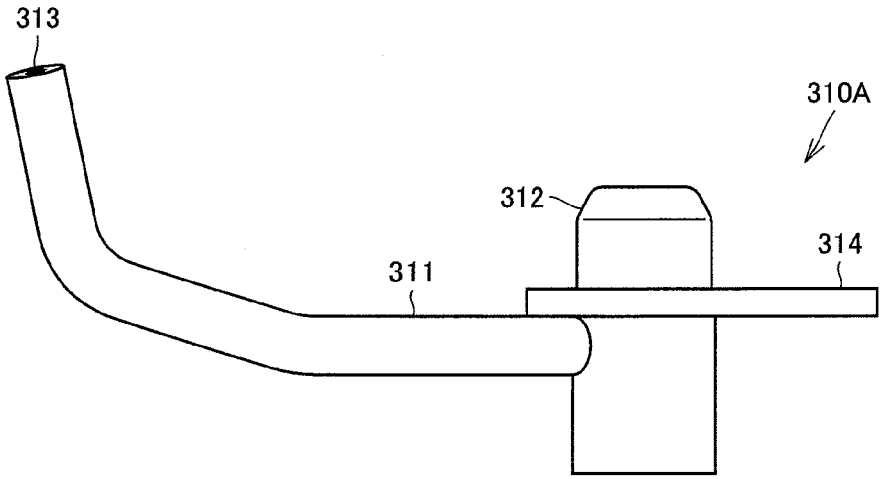
FIG. 33 is a side view of the oil jet as seen from the direction shown by XXXIII in FIG. 31.

FIG. 31 is a plan view of the oil jet according to the fifth embodiment of the present invention. FIG. 32 is a cross-sectional view of the oil jet taken along line XXXII-XXXII in FIG. 31. FIG. 33 is a side view of the oil jet as seen from the direction shown by XXXIII in FIG. 31.

Referring to FIGS. 31-33, oil jet 310A has a body 312, nozzle 311 connected to body 312, and a flange 314 by which body 312 is attached to the cylinder block. An opening 317 is provided in body 312 and a ball 315 forming a check valve is arranged in opening 317. Ball 315 is biased by a spring 316 and serves to stop oil that tends to enter from opening 317 in the direction shown by an arrow 318. The oil whose pressure shown by arrow 318 overcomes the pressing force by spring 316 flows in from the direction shown by arrow 318, flows through an oil flow path 313 and is injected from the tip of nozzle 311. With various changes in the strength of spring 316, the pressure at which oil jet 310A starts oil injection (valve opening pressure) can be changed.

Figure 34:
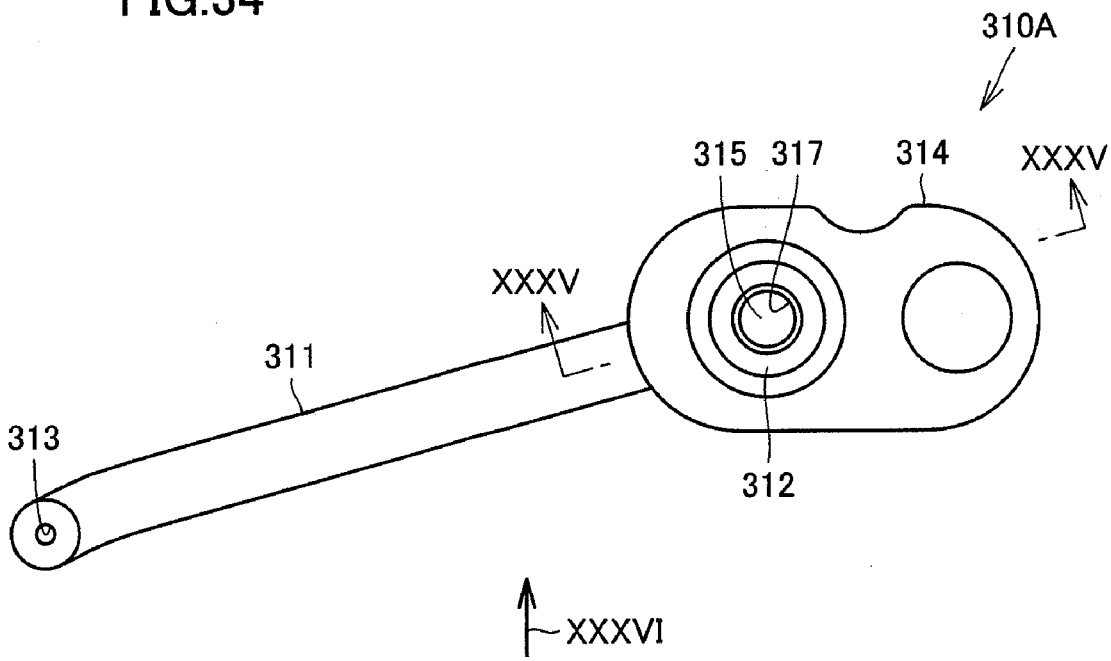
FIG. 34 is a plan view of an oil jet according to another aspect.
Figure 35:
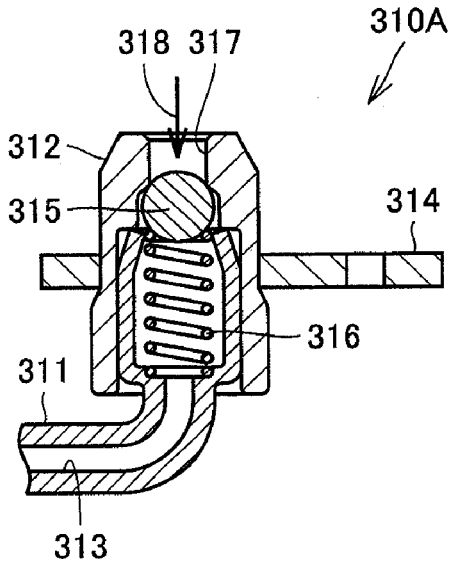
FIG. 35 is a cross-sectional view of the oil jet taken along XXXV-XXXV in FIG. 34.
Figure 36:
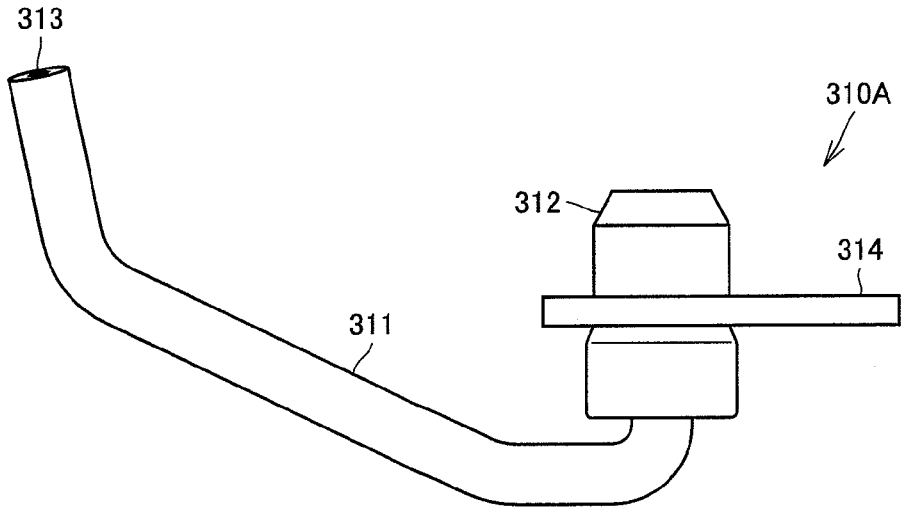
FIG. 36 is a side view of the oil jet as seen from the direction shown by an arrow XXXVI in FIG. 34.

FIG. 34 is a plan view of an oil jet according to another aspect. FIG. 35 is a cross-sectional view of the oil jet taken along XXXV-XXXV in FIG. 34. FIG. 36 is a side view of the oil jet as seen from the direction shown by an arrow XXXVI in FIG. 34. Referring to FIGS. 34-36, the oil jet in this example is different from the oil jet shown in FIGS. 31-33 in that opening 317 is provided at the top of body 312 and nozzle 311 is connected to the bottom. In this example, ball 315 is also pressed by spring 316 and spring 316 stops oil that tends to enter in the direction shown by arrow 318. When the pressure of the oil overcomes the pressing force of spring 316, ball 315 moves and the oil flows from opening 317 toward oil flow path 313 in nozzle 311.

Figure 37:
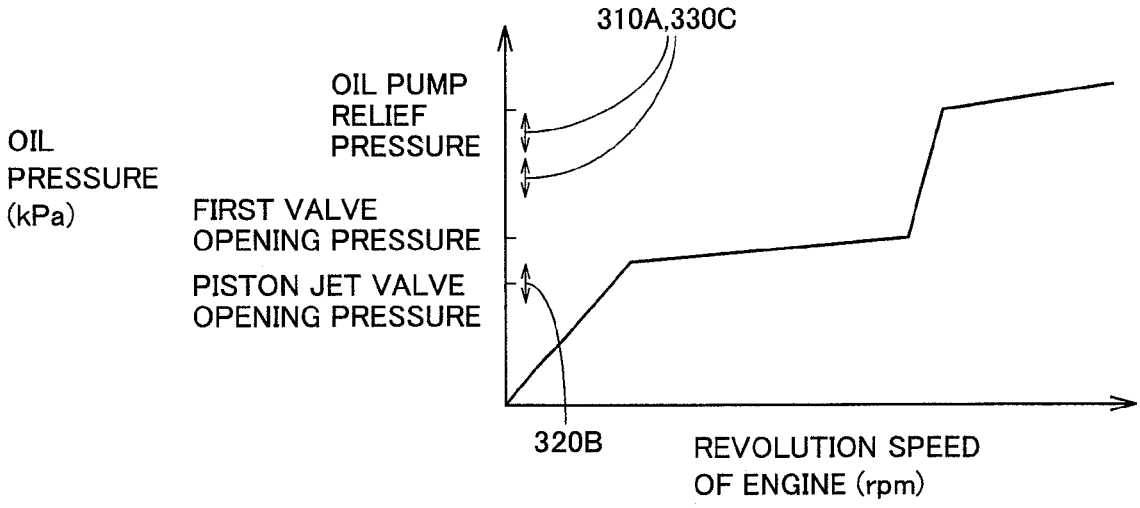
FIG. 37 is a graph showing the relationship between the oil pressure and the revolution speed of the engine.

FIG. 37 is a graph showing the relationship between the oil pressure and the revolution speed of the engine. Referring to FIG. 37, when the revolution speed of the engine (the horizontal axis) is increased, the oil pressure (the vertical axis in FIG. 37) is also increased because the revolution speed of the oil pump is also increased. The relationship between the valve opening pressure of the piston jet (oil jet) and the first valve opening pressure of the oil pump can be set in various ways. In FIG. 37, the valve opening pressure of the piston jet is set lower than the first valve opening pressure of the oil pump. Conversely, the valve opening pressure of the oil jet may be set higher than the first valve opening pressure of the oil pump.

In order to inject oil from the oil jet at low revolution speed, it is necessary to set the valve opening pressure of the oil jet not to exceed the first valve opening pressure of the oil pump.

Furthermore, in order to stop the oil jet at low revolution speed, it is necessary to set the first valve opening pressure of the oil pump not to exceed the valve opening pressure of the oil jet.

For example, the valve opening pressure of oil jet 320B can be set to the pressure close to the piston JET valve opening pressure, and the valve opening pressure of oil jets 310A and 330C can be set to the pressure that is slightly lower than the oil pump relief pressure.

Figure 38:
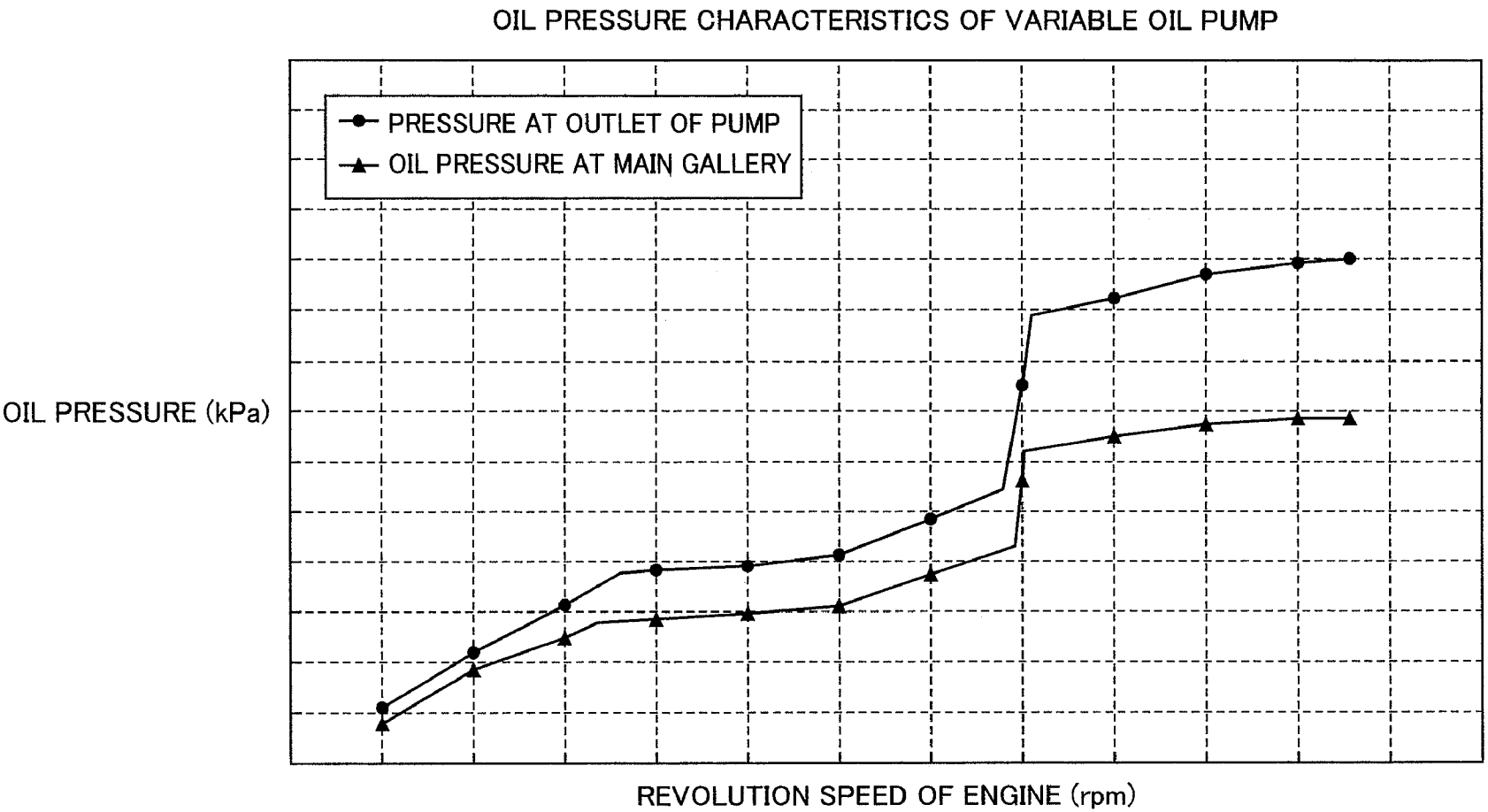
FIG. 38 is a graph showing the relationship between the oil pressure and the revolution speed of the engine.

FIG. 38 is a graph showing the relationship between the oil pressure and the revolution speed of the engine. FIG. 38 shows how the oil pressure at an outlet of the oil pump, the oil pressure at a main gallery (main oil hole), the oil pressure at an inlet of the oil control valve (OCV) having variable valve timing, and the oil pressure at a hydrolash adjuster (EX-HLA) of an exhaust valve change in accordance with the revolution speed of the engine. The oil pressure of the oil entering the oil jet is a little lower than the oil pressure at the main gallery and changes with the revolution speed of the engine.

In other words, in engine 1 serving as the internal combustion engine according to the fifth embodiment of the present invention, the oil supply portion includes oil jet 320B serving as a first oil supply portion from which oil is injected to skirt inner region 111, and oil jet 330C serving as a second oil supply portion from which oil is injected to skirt outer region 112. Furthermore, the oil supply portion has oil jet 330C serving as the second oil supply portion from which oil is injected to the region between the bores in skirt outer region 112, and oil jet 310A serving as a third oil supply portion from which oil is injected to the cylinder block end. Oil jet 320B has the lowest valve opening pressure, oil jet 310A has the highest valve opening pressure, and oil jet 330C has the medium valve opening pressure.

It should be understood that the embodiments disclosed herein are illustrative and not limitative in any respect. The scope of the present invention is defined by the terms of the claims, rather than the description above, and is intended to include any modifications within the scope and meaning equivalent to the terms of the claims.

The invention claimed is:

1. An internal combustion engine in which a piston reciprocates within a bore provided in a cylinder block and a connecting rod coupled to the piston transmits motive power to a crankshaft, comprising:

an oil supply portion through which oil is injected from a connecting rod side of said piston toward a part of the piston in an inside and an outside of a skirt of said piston; and an oil supply portion through which oil is injected from a connecting rod side of said piston toward a part of the piston in an inside and an outside of a skirt of said piston, wherein said oil supply portion includes a first oil supply portion from which oil is injected to said inside of the skirt and a second oil supply portion from which oil is injected to said outside of the skirt, and a first valve opening pressure at which said first oil supply portion starts oil injection is lower than a second valve opening pressure at which said second oil supply portion starts oil injection.

2. The internal combustion engine according to claim 1, wherein said oil supply portion includes said second oil supply portion from which oil is injected to a region between the bores in said outside of the skirt and a third oil supply portion from which oil is injected to a cylinder block end in said outside of the skirt, and the second valve opening pressure at which said second oil supply portion starts oil injection is lower than a third valve opening pressure at which said third oil supply portion starts oil injection.

* * * * *